US008424929B2

(12) United States Patent
Baragaño Gonzalez

(10) Patent No.: US 8,424,929 B2
(45) Date of Patent: Apr. 23, 2013

(54) SLIDING AND MODULAR PANIC SYSTEM WITH MINIMUM MOVEMENTS FOR USE IN EMERGENCY DOORS

(76) Inventor: José Ramón Baragaño Gonzalez, Gijón (ES)

( * ) Notice: Subject to any disclaimer, the term of this patent is extended or adjusted under 35 U.S.C. 154(b) by 0 days.

(21) Appl. No.: 13/022,805

(22) Filed: Feb. 8, 2011

(65) Prior Publication Data

US 2011/0215599 A1 Sep. 8, 2011

Related U.S. Application Data

(63) Continuation of application No. PCT/ES2009/070336, filed on Aug. 7, 2009.

(30) Foreign Application Priority Data

Aug. 8, 2008 (ES) ..... P200802398

(51) Int. Cl.
*E05B 65/10* (2006.01)
*E05B 65/00* (2006.01)

(52) U.S. Cl.
USPC ..... 292/92; 292/93; 292/94; 292/DIG. 65

(58) Field of Classification Search ..... 292/92–94, 292/DIG. 65
See application file for complete search history.

(56) References Cited

U.S. PATENT DOCUMENTS

| | | | | |
|---|---|---|---|---|
| 2,778,326 | A * | 1/1957 | Casimir Guzik | 109/63.5 |
| 3,970,339 | A * | 7/1976 | Haselton et al. | 292/227 |
| 4,709,950 | A * | 12/1987 | Zortman | 292/92 |
| 4,976,476 | A * | 12/1990 | Cross et al. | 292/92 |
| 5,011,199 | A * | 4/1991 | Lowe et al. | 292/92 |
| 5,219,385 | A * | 6/1993 | Yeh | 70/92 |
| 6,009,732 | A * | 1/2000 | Haeck et al. | 70/92 |
| 6,386,597 | B1 * | 5/2002 | Walsh, III | 292/92 |
| 7,832,777 | B2 * | 11/2010 | Banks et al. | 292/92 |
| 7,883,123 | B2 * | 2/2011 | Condo et al. | 292/92 |
| 2004/0183311 | A1 * | 9/2004 | Lin | 292/92 |
| 2004/0227353 | A1 * | 11/2004 | Cohrs et al. | 292/92 |
| 2007/0246946 | A1 * | 10/2007 | Arlinghaus et al. | 292/93 |

FOREIGN PATENT DOCUMENTS

| | | | |
|---|---|---|---|
| EP | 1355028 | A2 * | 10/2003 |
| WO | WO 9204519 | A1 * | 3/1992 |

* cited by examiner

*Primary Examiner* — Carlos Lugo
(74) *Attorney, Agent, or Firm* — Wenderoth, Lind & Ponack, L.L.P.

(57) ABSTRACT

A sliding panic bar is provided with a case which includes a configuration for electrical installation and rails for the frames of the self-locking latch, the release of which is produced by acting on a locking lever that centralizes different actuation situations. The activation by pressure of the movable half-bar causes the tilting of operating lever rocker arms which displace the shuttles, synchronous shaft and retaining springs. The system includes a mechanism for adjusting the width of the door, adjustment for use by physically handicapped people, as well as for vertical spagnolette systems, with both vertical and horizontal latch. The locks of the system are adjustable for absorbing possible expansions.

9 Claims, 24 Drawing Sheets

"A"

"B"

"C"

"D"

SLIDING AND MODULAR PANIC SYSTEM WITH MINIMUM MOVEMENTS FOR USE IN EMERGENCY DOORS

This application is a Continuation of International application PCT/ES2009/070336, filed Aug. 7, 2009.

OBJECT OF THE INVENTION

The present invention, as the title of this specification states, relates to improvements to modular evolutive systems for use in panic bars and similar locks, with the purpose of using the new multi-functional operation modular evolutive concepts, which have been conceived and made for providing significant advantages with respect to currently existing devices.

It can be applied to all types of sliding panic bars (Type B) for emergency exits triggered by a horizontal bar, both mechanical and electromechanical, with inhibition and for physically disabled people.

It is also an object of the invention is to create a new profile of the stationary half-bar for new uses.

The envelope assembly is also simplified by adding a simple crimp.

Also an object of the invention is to include basic functional changes in order to optimize the latches' release.

Furthermore a new dynamic compensation synchronous shaft is provided.

To meet fire regulations, the function of remote and side hinged aperture is included.

It also envisages a new system for adapting standard bars to different door widths.

Another object of the invention consists of simplifying and idealizing spagnolette systems.

A new mechanism is also included in bars for physically disabled people.

According to the above, the object of the present invention is the improvement of the structure of these systems in order to meet the premise of the UNE-EN 1125 standard, the main purpose of which is to allow a safe and effective evacuation with the minimal effort.

With regard to the operating system for use in emergency exits for physically disabled people, the invention aims to be operative under much lower pressures than those referred to in the in-force regulations. Also its basic mechanical construction with few elements meets an unusual reliability and durability.

Also, the variety of panic bars is complemented by the inclusion of the horizontal spagnolettes.

In some cases, a rationalization simplifying and streamlining the implementation and alignment of the necessary complementary elements providing very smooth sliding, consequently improving the spirit of the UNE-EN 1125 standard, is envisaged.

BACKGROUND OF THE INVENTION

Currently there is not any concept of design on the envelopes of the frames, for electrical panic bars.

As it is known, latches, rocker arms, spagnolette rods and elements for locking thereof, include torsion and traction springs in their configuration.

For the same reason, given the low demand of paragraph (4.2.6) of the current regulations in the construction of the conventional elements sensitive to the locking function, their manufacturing is usually made by stamping, and is not based on more complex configurations providing solids of equal resistance.

The adaptation of standard bars to diverse door widths is another area that admits redesign.

The spagnolette latches are antagonistic vectors added to the main latch vector.

In emergency exits for the physically disabled people, the Regulation guideline for minimizing the aperture force (3.18 of the Regulation) is even more important.

In addition, currently the optimization of Environmental Regulations is not achieved.

Currently, generic bars used for emergency exits, use torsion springs on the rotation shaft of the latch and sometimes for the recovery of spagnolette rods and levers. Also traction springs are used for the recovery of the upper and lower mechanism of the spagnolette latches, the latches of which are also assisted by torsion springs.

Obviously, traction and torsion springs are not exactly the most reliable.

In relation to the force required for the aperture (Standard 4.2.1), the conventional generic system uses two levers associated with respective torsion springs embedded in the head for dragging the latch during all its emerging displacement, and sometimes the spagnolette rods, also with the respective torsion and traction springs for their recovery.

As for the design of a panic device according to the Standard (in its paragraph 4.1.9), it should be such that the effective length of the bar is the closest to the width of the door for which it has been selected, but never less than 60% of it.

The variety of bars with the measures required by the user is expensive, generates stocking and delays. Often, manufacturers of emergency exit bars conventionally use two standards.

As for the conventional construction of the self-locking latch in spagnolettes, it includes a torsion spring on the latch, another traction spring for the mechanism recovery, and occasionally another torsion spring for the recovery of the lock stopper. This generic dragging arrangement is repeated in the configuration of bars with two and three anchor points. These vectors (top, bottom spagnolettes and bar) result in a considerable counterforce, per se, for unlocking the door.

According to the above, a poor attachment of the transmitting rods (spagnolettes) to their supporting element, can produce a permanent lock on the emergency exit.

Likewise, the philosophy of applying retention release instead of the traditional system: traction dragging, extends to the new horizontal spagnolette element. This mechanism integrates the existing modular elements in the main bar and in the vertical spagnolette mechanisms.

The recovery of the spagnolette shanks maintains the implementation of compression springs, not the torsion springs conventionally used.

The locks include non-enveloping, static impellers. In some cases for their alignment, dispense with the usual supplements, incorporating a simple and aesthetic adjustment.

The guiding supporting element of the spagnolettes (both horizontal and vertical) adds to their design a simple accessory that greatly improves the installation for alignment thereof.

DESCRIPTION OF THE INVENTION

In general, the improvements to modular evolutive systems for use in panic bars and similar locks, object of the present invention, are basically characterized in that regarding a configuration as the sliding panic bar, it includes a case bearing a boss, on which a sliding half-bar slides, through a guide made therein, thus eliminating other type of more complex assembly. There is a stationary half-bar that includes in its structure obtained by extrusion a new configuration for the electrical installation, including recesses differentiated of the prewiring and other specific connections that must be necessarily done. Profile crenellations for the correct alignment and movement of shuttles are envisaged, and having a necessary rigidity in their section when integrating the inhibition functions, which sometimes it has in its variants.

Inside the rails existing in the structure of this case for modular attachment, it houses a first supporting elements joined together with head frames having a double circular sector for achieving the double depression of the latch on its positioning shafts. This latch is characterized in that it includes an elevated self-locking member, being shifted from its geometric center for receiving a recuperating rod. Said rod, by means of the groove therein, moves along the positioning shaft together with its compression spring, and pivots on a shaft of a locking lever, thus replacing the classic torsion spring.

It has been envisaged that this locking lever, solid of equal resistance, performs the functions of: serving as unlocking element by actuating the follower on its external addendum, and by the adjacent, sometimes on the application shaft during the exit of physically disabled people. This locking lever also performs the function of armor in electrical configurations, houses its return spring and ensures that in case of fire, when the fuse provided for such purpose is melted, this lever is retained by a spring maintaining the lock.

On the other hand, the head frames at its top are assembled with the supporting element of the coil for making up the stiffness of the head block. Another improvement of the invention consists of including a skid, crimped or not, to an electromagnetic armor made of different alloys (same as its core in inhibition applications), determining a solid of equal resistance, having at its top a triangular-prism configuration and in the middle maintaining the parallelism by the situation of rods linked thereto and hinged on its shaft and on that of the latch. At its back, an open crenellation wherein a bushing for moving the synchronous shaft rigidly joined to the operating lever rocker arms is housed, is formed in their lower shafts in the first operating lever rocker arm and another in the second one. Thus it is independently moved, not associated with the dragging of the emerging element. These lower shafts or rapiers are assembled with the shuttles hosted in the crenellations, which for this purpose the stationary half-bar includes.

It has also been envisaged that the springs provided in the synchronous shaft, both for retaining and recovering the operating lever rocker arms, are of the compression type and that the rapier of the second operating lever rocker arm is non-magnetic, but including a permanent magnet so that its behavior is bi-positional, which particularity enables the displacement of the frame on the synchronous shaft in a very simple manner within the stationary half-bar at the desired measure, for adjusting the standard bar. This synchronous shaft is grooved, at cadence distances, from the locking recesses, so that the grooves serve as references for positioning the frame of the second lever, inserting the magnetic rapier, and once screwed proceeding with the manual break of the extra synchronous shaft, for subsequently cutting into a generic manner the half-bars and proceeding again to the new assembly.

On the other hand, the locking mechanisms in spagnolettes modularly include the same latch of the main bar, as well as the same self-locking system, the same pivoting rod and identical retaining rods. These rods are articulated in a new skid grooved at its base for limiting its movement by a boss integral with the frame and covered with a polyamide guide bushing. This also retains the return spring of the stem attached to the frame through a shaft.

This stem is guided at its end by the crenellation provided in the frame.

Another improvement that involves the invention, lies in the fact that when joining a tandem for physically disabled people, the basic element is to include a shaft that with minimal movement and extensive post-race, allows the release of some "inverted levers", pushing the corresponding shuttle, and due to the nexus of the spagnolette to the rod tandem, moving with minimum effort this shaft from the resting position, a spring being the only element to restore the operating cycle of the bar for physically disabled people.

The selection of materials for the few modular elements, with minimal movements, friction and implementation with compensating compression springs and the reduction of forces in cascade, result in a minimum counterforce vector.

The integration of complements for its total or partial electrification, by eliminating complementary elements (air-cups, electric locks), their implementation cost and aesthetic, results in a high-reliability and durability product, very low energy assembly and reduction of noise pollution.

In the mechanisms of horizontal spagnolettes, with regard to the vertical ones the skid is slightly modified, being provided with a double angular embossment and sliding guide on the frame base.

Likewise, some transverse supporting elements are joined to the mechanical (modular) frame, depending on its hand, which have a guiding function so that the angular retainers are aligned with the spagnolette through the guides of the head supporting element on the rod dowels. This alignment is complemented by including in the shank or spagnolette a guide supporting element with three points-crenellated design, the pitch diameter of which is slightly greater than that of the shank, this difference in diameters is intended to house, during mounting, a bushing that after attaching the guide will be moved from the crenellations being positioned by gravity on the lower stoppers of the shanks, thus eliminating the possible friction that would occur without this accessory between the bar and the spagnolette mechanism.

The same concept applies for the installation of a second bushing, disposable after assembly, on the rod dowel ensuring the adjustment in a simple and unambiguous manner, and the looseness needed for the proper functioning of the spagnolette mechanisms.

Another element that has been object of study is the locks. In both, the simple visual inspection is sufficiently explicit. The one on the ground is formed by a crenellated supporting element that places an impeller with a protective envelope.

The adjustable side lock is configured by a supporting element that transversally houses a cam-rocker joined to the support element through a shaft mounting a dual-coil return spring. A double male-female impeller bears this rod, at its anterior end, and the position thereof being regulated, with respect to the plane of incidence on the latch, by a simple screw that acts on the posterior addendum. Once attached and regulated this mechanism is covered and attached with its corresponding envelope.

BRIEF DESCRIPTION OF THE DRAWINGS

In order to facilitate the understanding of the characteristics of the invention and being an integral part of this specification, layout sheets are attached in the figures of which, with an illustrative and not limitative manner, the following has been represented.

DESCRIPTION OF THE PREFERRED EMBODIMENT

Figure 1:
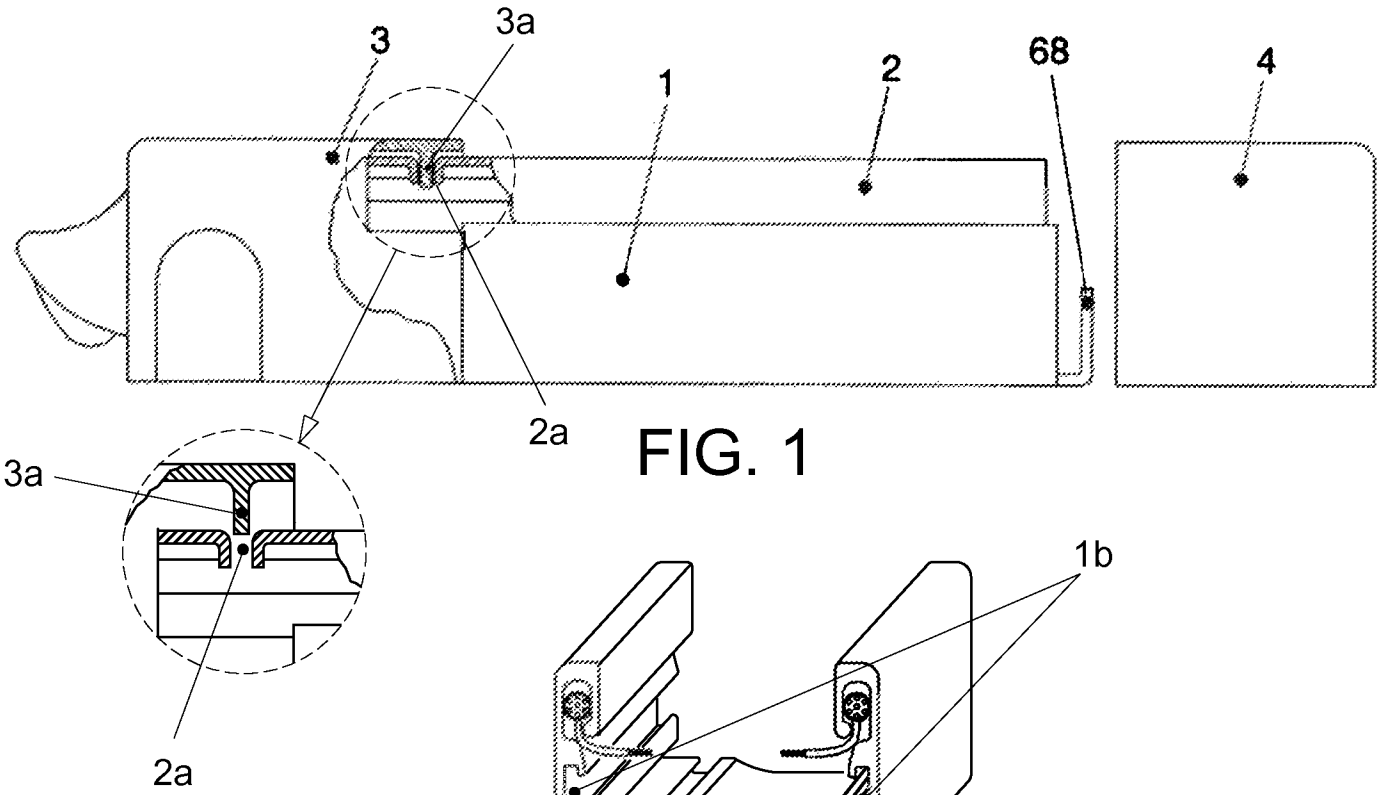
FIG. 1.—It is a partially sectioned elevational view of the envelopes making up the rocking-side hinged/abatable-sliding bar.

Referring to the numbering adopted in the figures, the improvements to modular evolutive systems for use in panic bars and similar locks, which are contemplated by the invention, can clearly be seen and preferably in rocking-side hinged/abatable-sliding and doubly rocking latches.

The nomenclature used in the designation of the parts involved in the description is as follows:

1. Stationary half-bar
1*a*. Rails
1*b*. Crenellated
2. Movable half-bar
2*a*. Guide
3. Head case
3*a*. Boss
4. Rear case
5. Latch
6. Self-locking clutch
7. Self-locking lever
8. Retaining stopper
9. Head supporting element
10. Head frame
11. Bar follower
12. Locking lever
13. AR/RF coil supporting element
14. Transmitting rod
15. Pivoting rod
16. AR coil armor
17. AR coil core
18. Coil reel
19. Washer
20. Upper abatable-rocking latch shaft
21. Lower rocking-sliding latch shaft
22. AR core dielectric
23. Main pivoting rod bar locking shaft
24. Self-locking shaft
25. RF retaining guide shaft
26. Operating lever rocker arms
27. RF spring
28. Fuse
29. Main locking spring
30. Main shuttle-unlocking shaft
31. Modular (bar) skid
32. Skid-retaining rod crimping shaft
33. Electromechanical frame
35. Operating second lever frame
35'. DF first lever frame
36. Synchronous shaft guide bushings
37. Synchronous shaft
38. Latch stopper bushings
39. Frame separating shaft
40. Separator-frame shaft bushing
41. First electromechanical shuttles
41*a*. Inclined plane
41*b*. Transverse groove
42. Second Integral configuration shuttles

Figure 2:
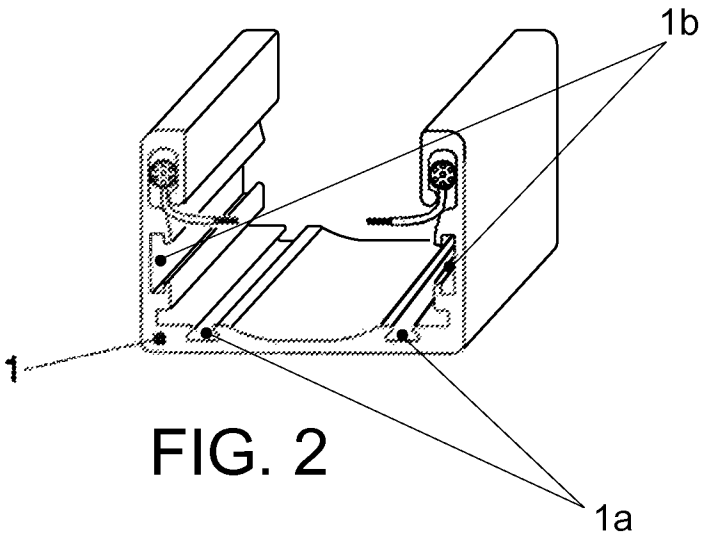
FIG. 2.—it is a section of the stationary half-bar.

43. Third DF configuration shutters
44. Dowel, DF configuration shuttles
45. Movable armor
46. Inhibiting core
47. Integral spring
48. Electromechanical spring
49. Operating lever spring
50. Permanent magnet
51. DF spagnolette rod-operating bar
52. DF spagnolette rod-main bar
53. DF spagnolette
54. Movable half-bar guiding shaft
55. Operating lever rotation shaft
56. Lower shuttles bar lever shaft
56*a*. Longitudinal groove
57. Rocking guiding shaft
58. Non-magnetic rapier
59. Spagnolette rods
60. Spagnolettes-rods shaft
61. Rod dowel, spagnolette retainer
61'. Disposable bushing for the adjustment between the rod and the spagnolette mechanism
62. Dowel forwarded
63. Rod dowel, in DF configuration
64. DF shaft
65. DF shaft spring
68. Frame, rear case
74. Spagnolette mechanism frame
75. Spagnolette skid
76'. Horizontal Spagnolette skid
77. Stem for positioning spagnolette skid
78. Spagnolette skid spring
79. Stem-skid shaft in spagnolettes
80. Rod skid shaft, in spagnolettes
81. Skid limiting shaft, in spagnolettes
82. Dampening bushing of the limiting shaft
83. Guide supporting element
84. Vertical spagnolettes
84'. Spring supporting element of the horizontal spagnolette
85. Horizontal spagnolette frame
85'. Side frame of the horizontal spagnolette
86. Angular retainer
86'. Limiting dowels for the angular retainer
87. Spagnolette guiding supporting element
87'. Movable bushing for adjusting the spagnolettes
88. Ground lock supporting element
88'. Ground lock impeller
89. Ground lock envelope
90. Adjustable side lock envelope
91. Adjustable side lock supporting element
91'. Guide cylinder for regulating the rod
91". Rocker shaft guides
92. Rocker rod
92'. Rocker addendum
93. Rocker retaining spring
94. Male impeller
94'. Female impeller
95. Rocker shaft
96. Rod positioning screw
M6. Compensating spring
M7. Compensating spring
M15. Compression spring
M84. Return spring for spagnolettes with horizontal mechanism
T83. Screw As for the evolutive systems (evolutive envelopes) it can be seen that in the stationary half-bar 1 (FIG. 2) the profile extrusion is due to new functional applications with respect to the known art:

To the proper alignment and movement of "the shuttles" first shuttle (41), second shuttle (42), third shuttle (43), the latter in bars for physically disabled people, being a new operative element and ultimately responsible for the manual aperture from inside.

To the prewiring location and the strangulation of this channeling for the correct exit of single-drivers ensuring no collision with the movable half-bar 2 (FIG. 1) or other elements. See one-line exits on the left side of FIG. 3.

Figure 3:
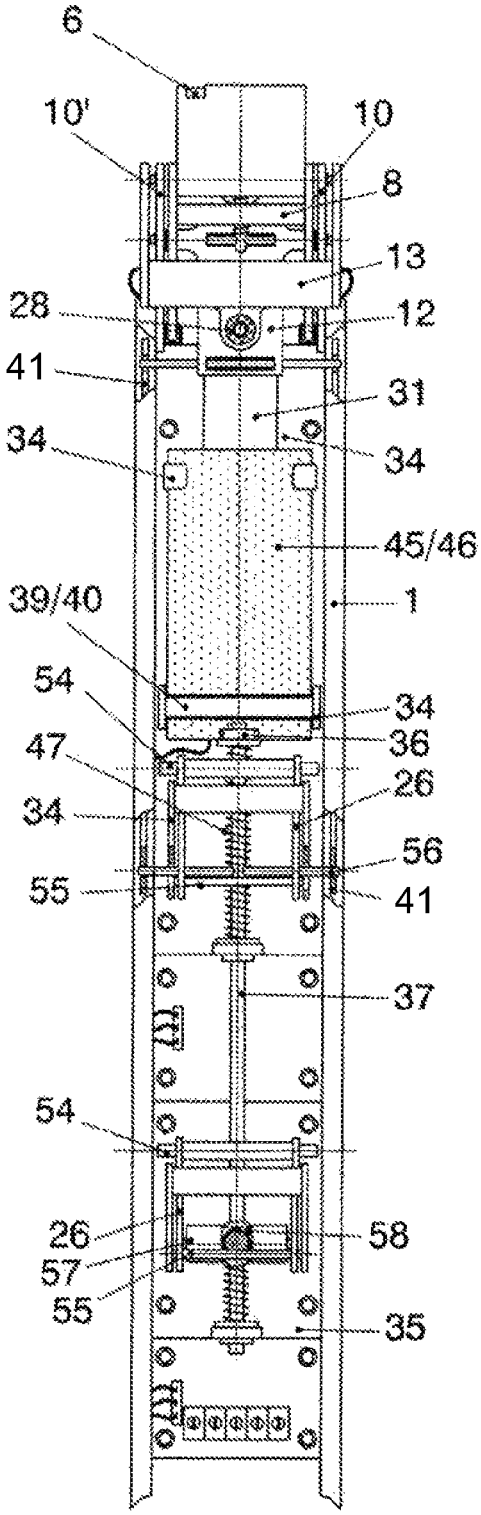
FIG. 3.—It is a plan view of an integral configuration of the system according to the invention.

To the implementation of reinforced sections for providing the strength required by the pressures from 5000 N/m$^2$ that necessarily have to be withstood when the system includes the inhibition or electromagnetic retention (45-46) (see FIG. 3).

To the assembly, the movable half-bar 2 (FIG. 1) has a hole in the manner of guide 2*a* in its front for housing and serving as a guide in its short extension to a boss 3*a* (which can be seen in the section detail of FIG. 1, which incorporates the head case 3. This simple functional solution adjusts the longitudinal movement, with no additional elements. This solution provides rigidity, clean execution and element economy.

Figure 5:
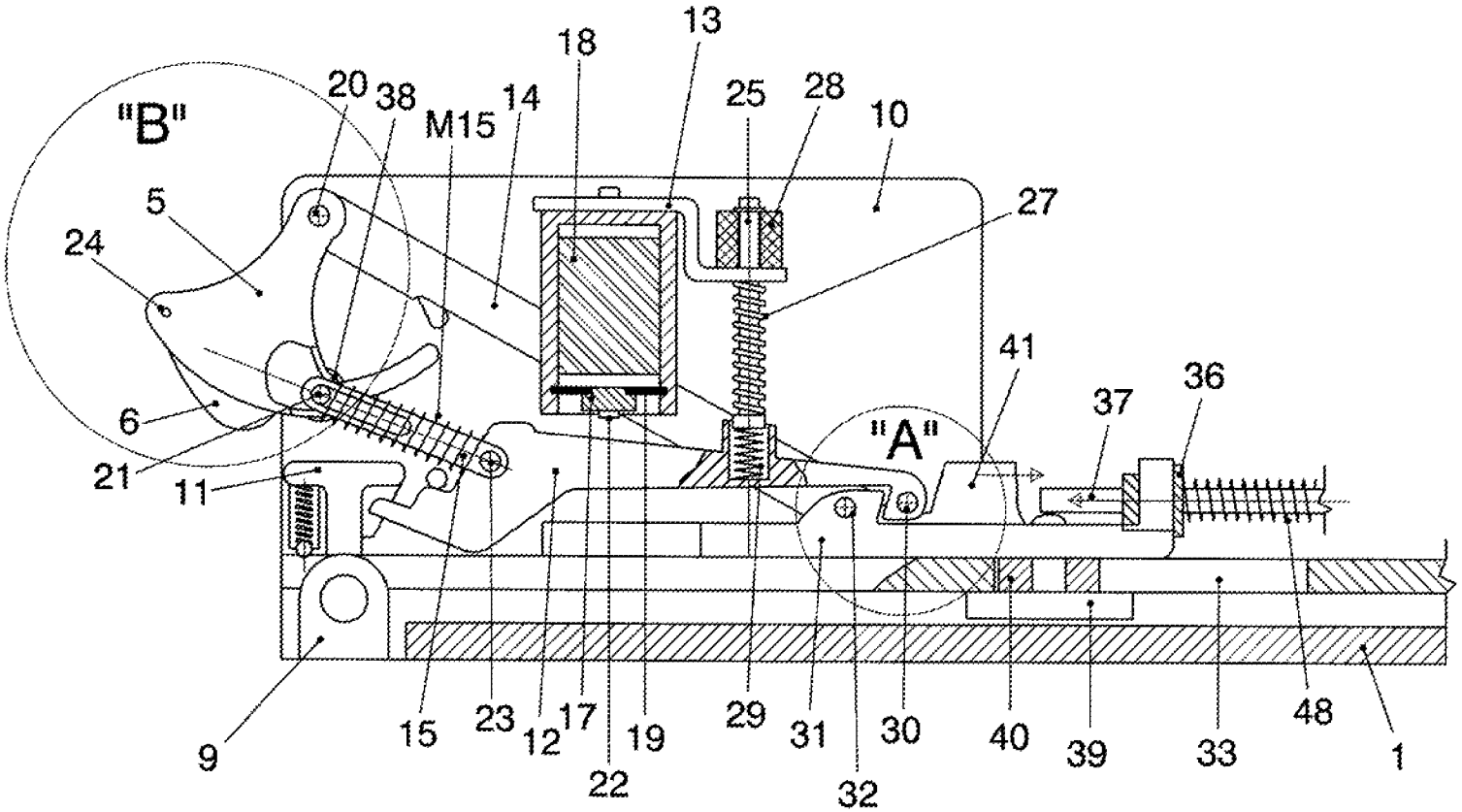
FIG. 5.—It is a partially sectioned elevational view of the main mechanisms housed in the main head frame.
Figure 6:
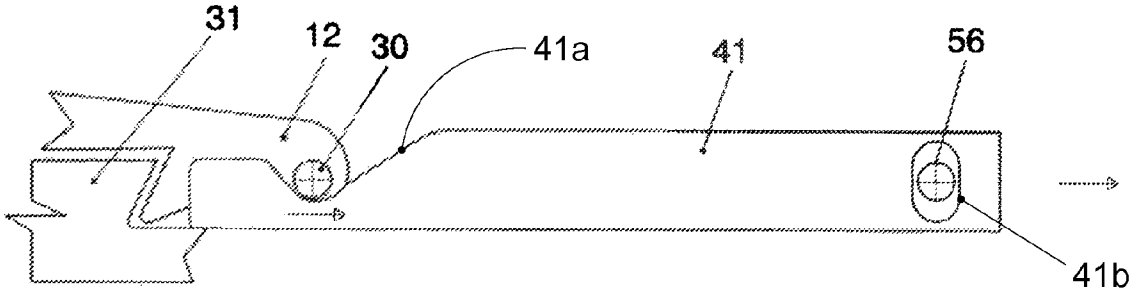
FIG. 6.—It is an enlarged view of detail A in FIG. 5.
Figure 7:
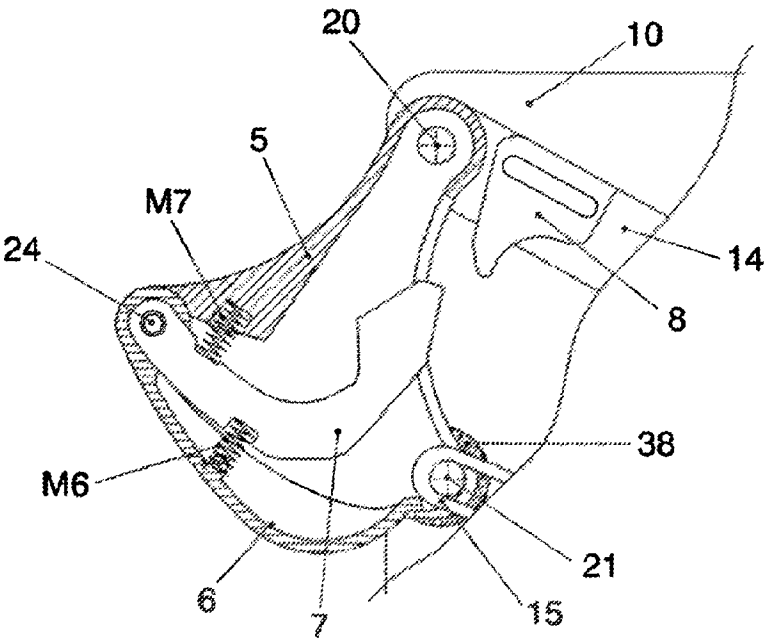
FIG. 7.—It is an enlarged view of detail B in FIG. 5.
Figure 15:
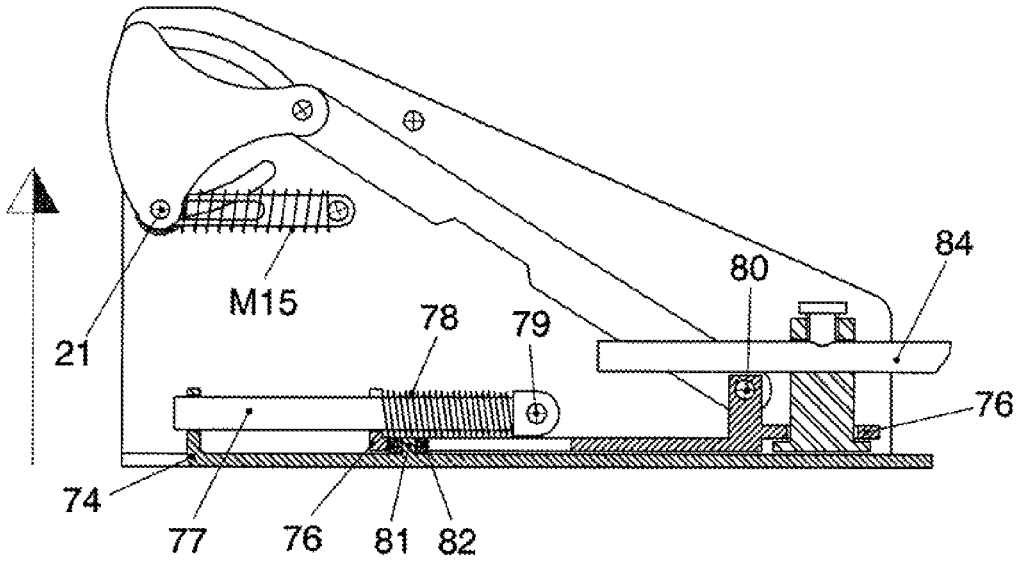
FIG. 15.—It is a view similar to that of FIG. 14, in the aperture position of the door.
Figure 16:
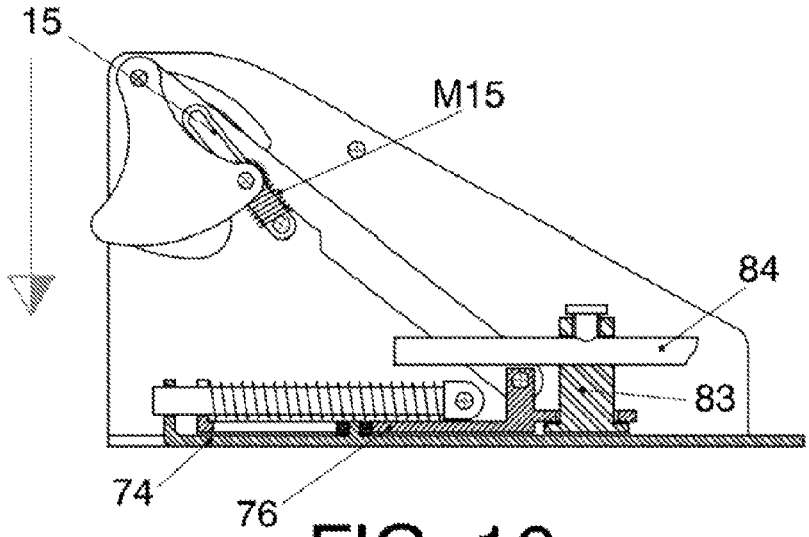
FIG. 16.—It is a view similar to that of FIG. 15 in the position corresponding to the closure of the door.

Another improvement of the invention referred to the implementation of the compression springs and dynamic compensation in order to optimize the regulation on minimal efforts for the aperture, removing the torsion springs of the known art, these can be seen in FIG. 5 and their enlarged details A and B shown in FIGS. 6 and 7, respectively. The partial hollow of the latch 5 with the lateral movement of the elevated self-locking member (compensating compression springs, first spring M6 and second spring M7), allows, during the rocking displacement on the lower shaft 21, housing in the latch 5 of a grooved and pivoting rod 15 on the shaft 23 of the locking lever 12. Between both shafts, the compression spring M15 is housed. This alternative provides two advantages: first, removing the classic torsion spring in latch heads, and second, without doubts the more important, performing its specific function of "positioning the latches in their emerging position" and acting (FIGS. 15 and 16) only as a recuperating member when the door is closed, both in the spagnolette mechanisms and in the main bar. Instead, "it is not a counterforce for the aperture movement," both from the inside and from the outside.

Figure 8:
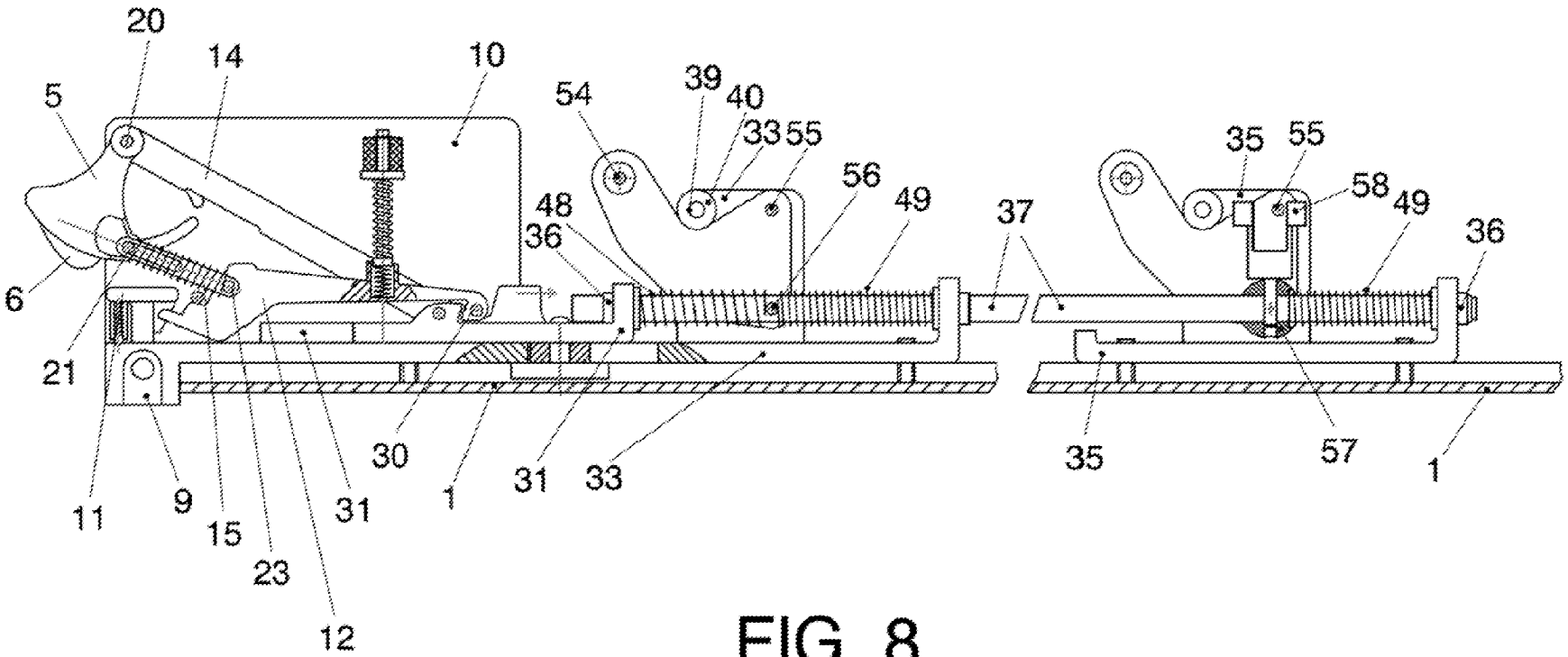
FIG. 8.—It is a partial elevational view of the final configuration according to FIG. 3.

Alternatively, in order to also achieve a small force required for the aperture (according to Standard 4.2.1), such as it is shown in FIG. 8, there are two operating lever rocker arms 26 rigidly joined by a lower shaft 56 and rapier 58 to a bar or synchronous shaft 37 within two U-shaped frames 33 (electromechanical frame) or 34 (integral frame), and movable frame 35, these operating lever rocker arms 26 being articulated at their midpoint in a rotation shaft 55, such that the upper shaft 54 slightly moves along the rails, which for such purpose maintains the movable half-bar 2 (FIG. 1) or operative.

It is noteworthy that the recuperation springs 47, 48 and 49 (FIGS. 3 and 8) are compression springs sliding on the synchronous shaft 37 and are located between the lower shafts 56 of the rockers and the crenellated grooves, and the referred rockers are provided with self-lubricated bearings 36, both in the frames themselves and in the skid 31 with or without electromagnetic armor (45, 46). All the crenellations have tolerance at their height "z" to absorb the small pendulum movement that produces the arrangement of the operating lever rocking arms 26.

Figure 11:
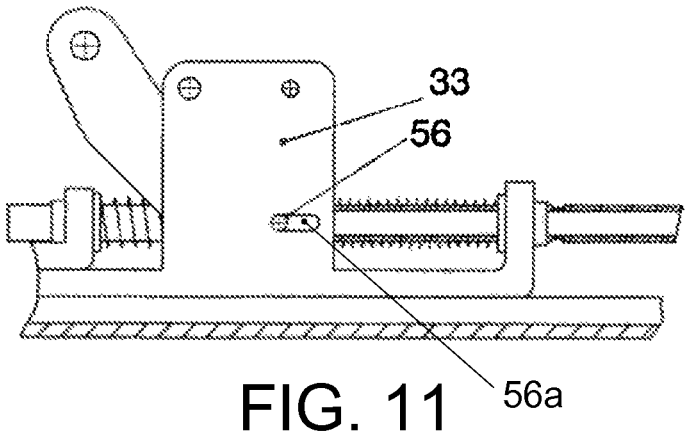
FIG. 11.—It is an elevational view, similar to that of FIG. 10, by the rear part.

Noting the "U"-shaped frame wherein the first (34 integral, 33 mechanic and 35' for physically disabled people) lever is housed, there is a longitudinal groove 56*a* into which the lower shaft 56 of the operating lever rocking arms 26 plays, which is located in the respective frame 33-34 (FIGS. 8 and 11) and frame 35' (FIG. 19) at the height of the lower rotation shaft 56 of the operating lever rocking arms 26, which longitudinal groove 56*a* is intended for allowing, because of its channel, the emergence of said shaft 56 and connecting with the shuttles (41, 43) which in turn have other transverse groove 41*b* for absorbing said pendulum effect (see detail A in FIG. 6). In this detail is also seen that when actuating on the movable bar with minimal movement, a shrink movement in the favorable sense is generated on the shuttles 41, unlocking the retaining system.

Figure 4:
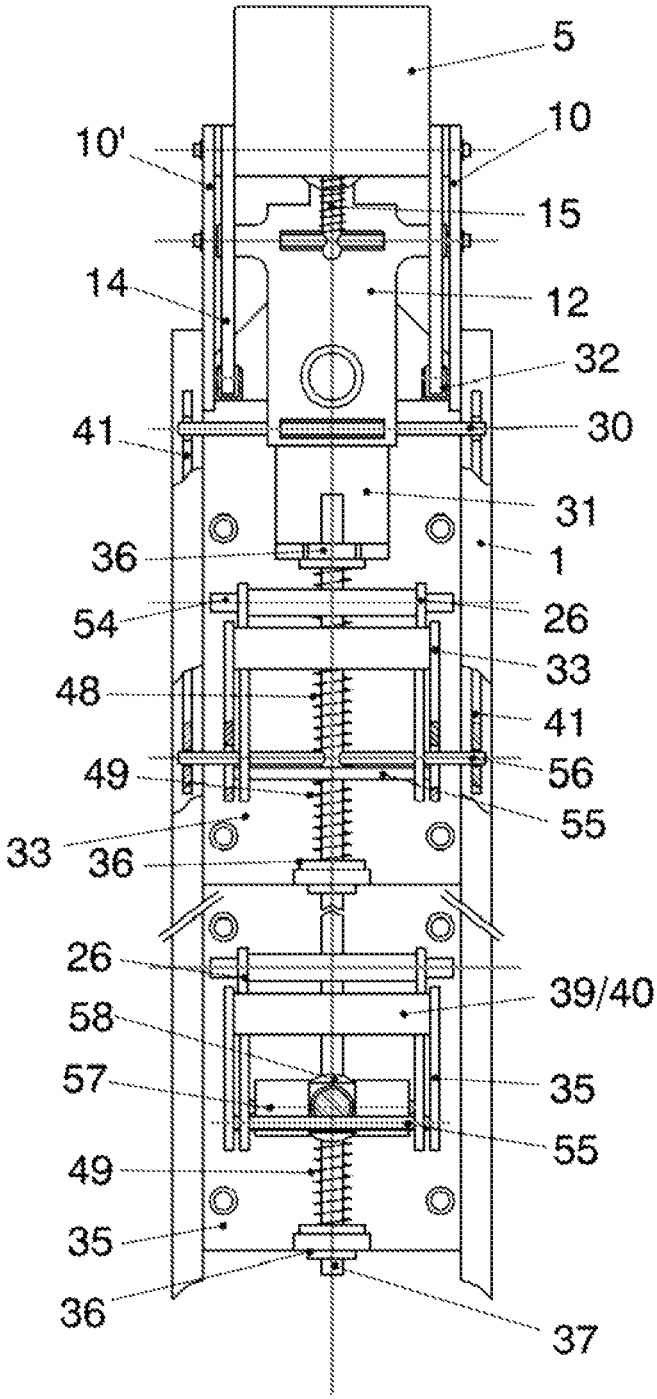
FIG. 4.—It is a plan view of the same mechanical configuration of FIG. 3, without the supporting element and the spring of the locking lever.

In FIGS. 3 and 4 and FIG. 8 the synchronous shaft 37 is of dynamic compression according to the working sequences thereof:

In a first sequence (static position) the springs 49 housed in the bar or synchronous shaft 37 of the operating lever rocking arms, are responsible for the recovery of the movable half-bar 2 weight and the small push of the positioning spring (47-48) of the block corresponding to the latch 5, this with no antagonistic spring.

In a second sequence (unlocking) the shuttles 41, with minimal movement (see FIG. 6) acting on the movable half-bar 2 release, by acting on the shaft 30, the retention exerted by the locking lever 12 on the modular (bar) skid 31.

In a third sequence (retraction of the lock), by still acting on the movable half-bar 2, once the lock is released, a post-race is immediately produced, which added to the initial movement decreases the elongation, increasing the effective working length of the springs (47-48) for positioning the lock on its retraction.

In a fourth sequence (restoration), once the door is released from its frame, the vectors generated by the three springs of the synchronous bar are added together, making up the system again.

In the fifth sequence (closing), the elastic spring of the pivoting rod 15 that is incorporated to the latch 5 and the minimum friction generated under its inclined plane are the only forces that the bar has for its re-hooking.

This arrangement contemplates the basic application of Hooke's Law for producing a balance of forces with very low torque in all sequences. With this working mode of the dynamic compensation synchronous axis compliance with the European Standard EN1125 is effectively achieved, which has as premise a safe and effective evacuation through a door with minimal effort.

As for the versatile retaining system performed by the locking lever 12, given the particularity of the releasing and not dragging mechanism in the conventional panic bars that the double rocking latch 5 has, the most sensitive elements have a different particular design.

FIG. 5 shows that on the locking lever 12, made of a solid of equal resistance and casting alloy, crenellated in its two shafts (23, 30) the following seven functions are carried out:

- Through the external operating device, the aperture square bar rotates the follower 11 on the addendum of the locking lever 12. Its rigidity is such that the external device allows unlocking the skid 31 even after remelting the fuse 28 at high temperature and facilitating the intervention of firefighters.
- The shaft 64 for physically disabled people acts on its adjacent addendum, which moves through its spagnolette the complementary bar for these.
- In its double crenellated, rotation shaft, a pivoting rod 15 with its return spring M15 replacing the classic torsion spring, emerging positioning of the latch, is articulated.
- On the area closer to the rotation shaft there is the remote and side-hinged aperture coil 18. The dual dielectric that has on the one hand the core 17 at its base 22 and the constructive fact that the locking lever 12 in its function of armor, when is attracted by the coil 18, maintains a residual gap, does not allow residual magnetism.
- Then the lever 12 shows an embossment into the bottom of which a compression spring 29 limited in its movement along the shaft 25 for the recovery of said lever, is housed. This shaft, slightly doomed in the embossment, has the added function of ensuring (when temperatures are close to the deflection curve of the spring 29 by the remelting of the calibrated polymer, thermal fuse 28) the firing of its spring 27 causing the interlock of the locking lever 12. In response to the RF Regulation.
- Next the protrusion retaining under a small negative angle, the skid 31 in locking position (see FIG. 6) is located at the front.
- Finally, at its end within the corresponding crenellation, there is the main shaft 30 that, by the action of the shuttles 41, prior to the actuation of the operational movable half-bar 2 releases the skid 31 from its interlocking resulting in the manual opening when pushed.

Another improvement of the invention is determined by the flexible system for optimizing Section 4.1.9 of the Standard (as specified in the Background of the Invention section). The levers, on which the movable half-bar 2 acts, must be rigidly joined and at the end points of the bar so as to prevent torsions and consequently the inefficiency of the system.

Figure 10:
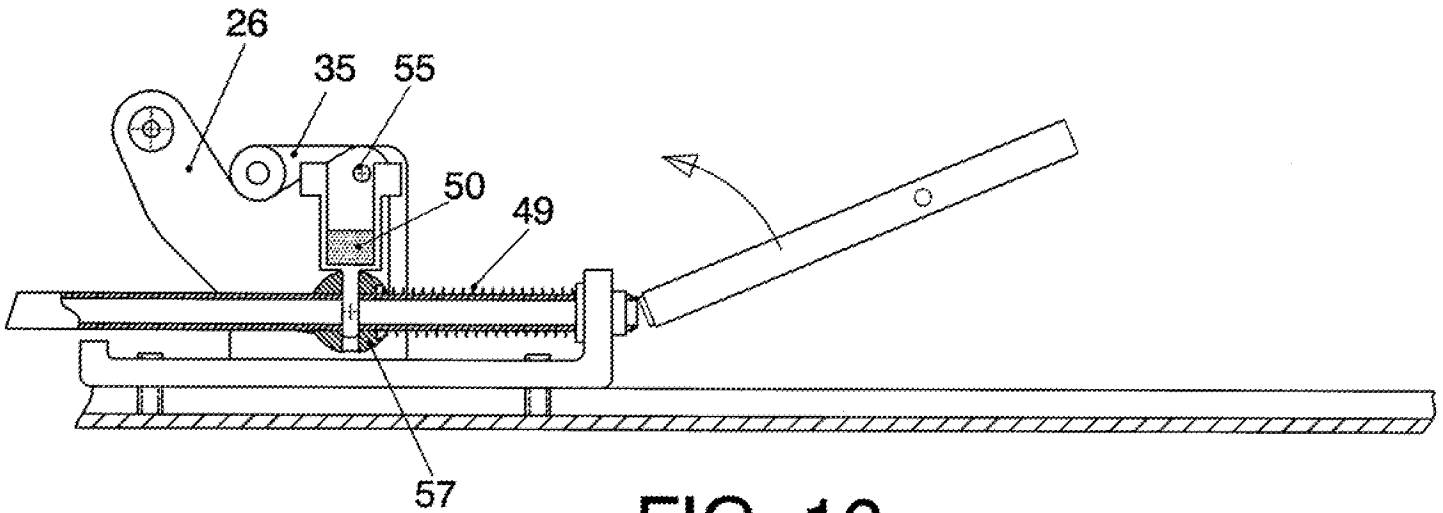
FIG. 10.—It is an elevational view, similar to that of FIG. 9, of the new positioning, locking and breaking of the extra synchronous shaft.

The synchronous shaft 37 (FIG. 8) has tubular configuration and is machined, being provided with a drill in the outer part of the functional head for housing the shaft 56 (rapier) of the levers-shuttles and according to the standard selected, several transverse drills are cadence distanced from the first, with guidelines for these holes, some grooves, which without diminishing the resistance of this synchronous shaft 37 to the traction, do allow its rupture, by manually applying a transverse force (see FIG. 10).

Figure 9:
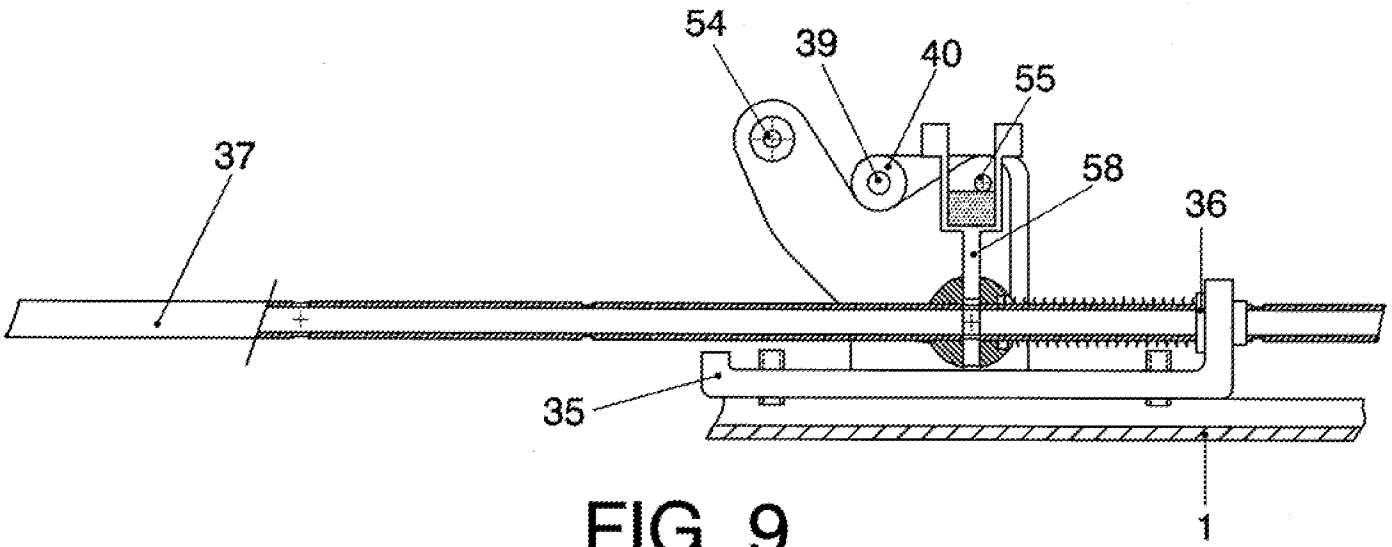
FIG. 9.—It is a schematic view of the frame and a complementary lever in its disengagement prior to the movement.
Figure 12:
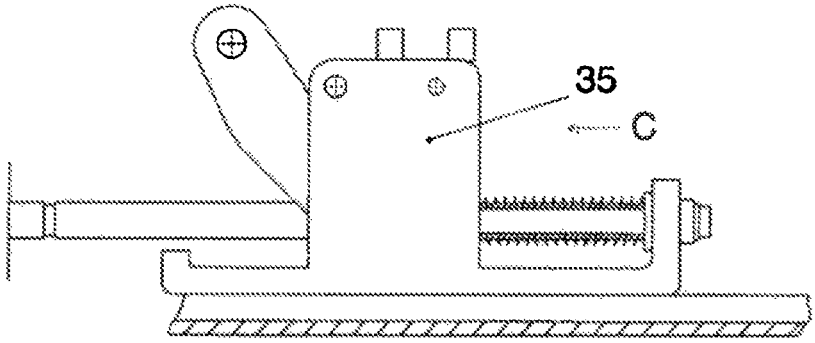
FIG. 12.—It is an elevational view, similar to that of FIG. 11, of the complementary lever frame.
Figure 13C:
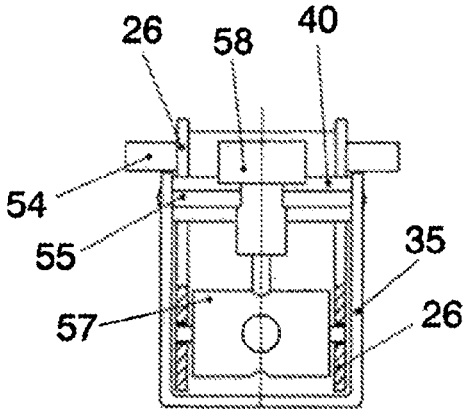
FIG. 13.—It is a side elevational view, in the direction of the arrow C in FIG. 12, showing the mechanism of the magnetic rapier.
Figure 14:
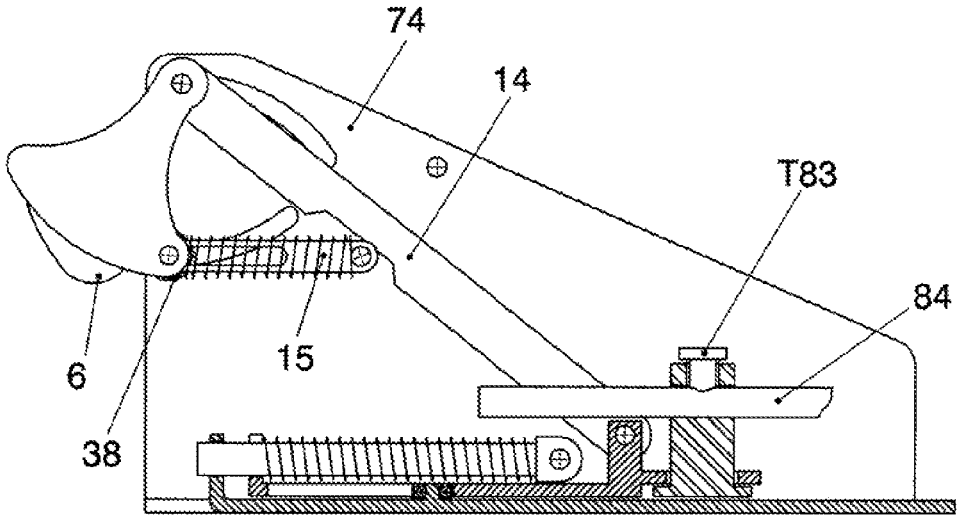
FIG. 14.—It is a sectional longitudinal partial elevational view of the frame of the spagnolette mechanism in its resting position.

This new system is complemented by including within the operating lever rocking arms 26 two new elements: the first one, according to a partial section view of A of FIG. 12, corresponding to FIG. 13, is a double slender, rocking guide shaft 57 made of steel, articulating its ends in the lower holes of operating lever rocking arms 26 for housing thereof. This shaft is drilled at two diameters and transversely at its geometric center, on the one of larger diameter the synchronous shaft 37 is moved, and on the one of smaller diameter a nonmagnetic rapier 58 which has the distinction of containing a permanent magnet 50 is housed. This second element, nonmagnetic rapier 58, is manually lifted and remains suspended releasing the synchronous shaft by the container action that creates the field on the rotation shaft 55 of the lever, also made of steel. Once the longitudinal rails are unscrewed (see FIG. 9), which for such purpose carry the stationary half-bar 1 (see FIG. 2), "the subassembly is moved to the required position", such that for interlocking again the new nonmagnetic rapier 58, the groove adjacent to the selected drill serves as reference. The rapier is lowered with minimal pressure (as lifted) being strongly retained in its new housing and feasibility locking the synchronously shaft thanks to higher field generated on the shaft 57. It is fixed through the four screws thereof to the stationary half-bar 1 and then the extra of the synchronous shaft 37 (see FIG. 10) is "manually, without tools" broken. Finally, as generic, the half-bars 1 and 2 are cut and the new assembly is performed. With regard to the new system of latches in spagnolettes, unlike conventional construction of the spagnolette self-locking latch that is optimized, according to FIGS. 14, 15 and 16, and following the same philosophy as the bar, the spagnolette latches maintain the same elevated self-locking clutch member 6 without antagonistic resultant vector, and the replacement of the classic torsion spring of the upper shaft of the latch by a pivoting rod 15 with its compression spring M15. The transmitting rods 14 act joined to a new skid 76 hooked through the shaft 80. This skid 76 has a groove at its base and its route is limited by a shaft 81 jointly connected to the frame 74, this shaft being as all shafts of the bar frames, surrounded by a bushing 82 dampening the collision of the position corresponding to FIG. 15 for passing to that shown in FIG. 14. Other bushings made of polyamide 38 are on the lower shaft 21 for dampening the collision of the position of FIG. 16 to that shown in 14, the same way as in the main bar.

Figure 17:
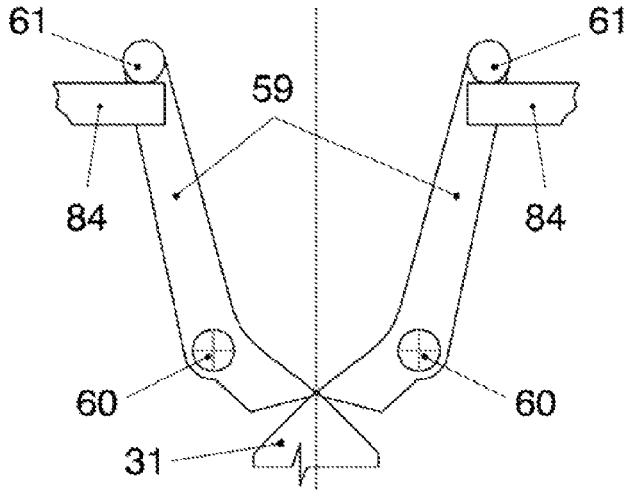
FIGS. 17 and 18.—These are sketches corresponding to the positioning of the spagnolette rods of the alternative movements according to a plan view of the conventional mechanism intended to be optimized with the invention.
Figure 18:
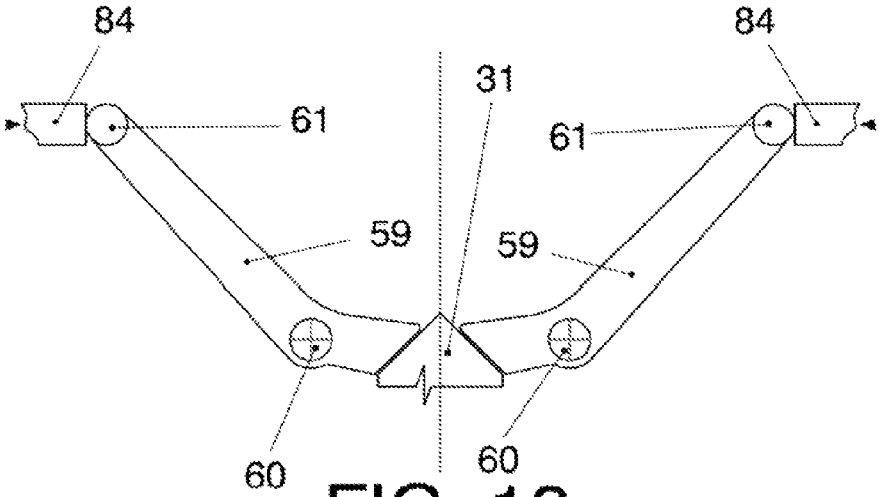

A stem 77 is retained by the shaft 79 jointly connected to the frame 74, and includes a return spring 78. This stem is perfectly positioned between the inverted crenellations of the frame 74 and those of the skid 76, the skid bearing a housing on the back for containing the attaching guide supporting element 83 of the spagnolettes 84, held by the dowels 61 which include the spagnolette rods 59 and, which are released with minimal effort, when the skid is moved from the bar 31, as shown in the positional diagram of FIGS. 17 and 18, respectively corresponding to the positions of FIG. 15 and those of FIGS. 14 and 16.

It is noteworthy that this spagnolette system proposed by the invention, by being for releasing and not dragging, in case of an incorrect attachment of screw T83 retaining the spagnolette 84 in the guide supporting element 83, "it does never lock the emergency exit".

Regarding the operating system for use in emergency exits for physically disabled people, as mentioned above, the locking lever 12 had an embossment that could act on the shaft 64 for physically handicapped people, releasing the lock.

Figure 19:
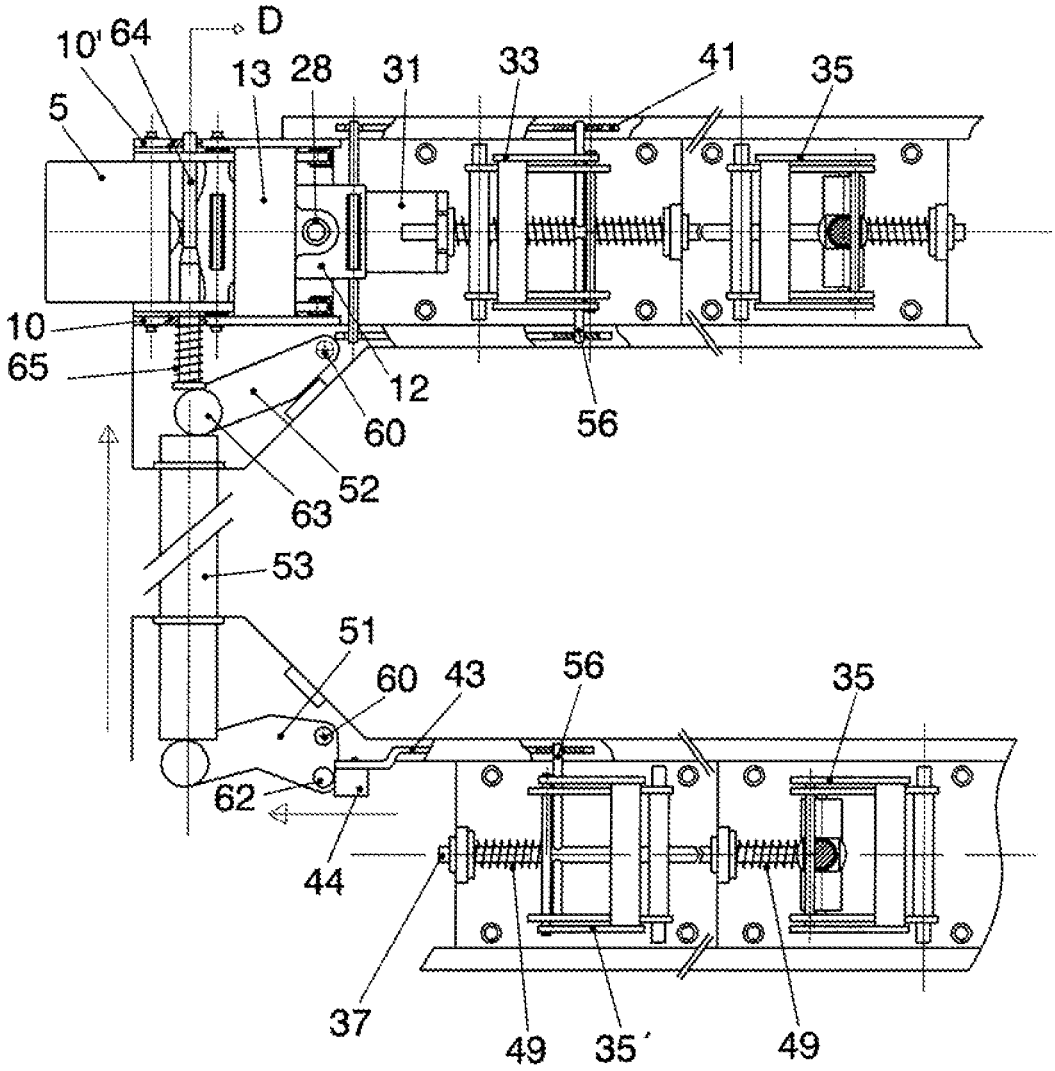
FIG. 19.—It is a plan view of a configuration that according to the invention joins the main electromechanical bar, in this case, with an auxiliary bar to be actuated by physically disabled people.
Figure 20:
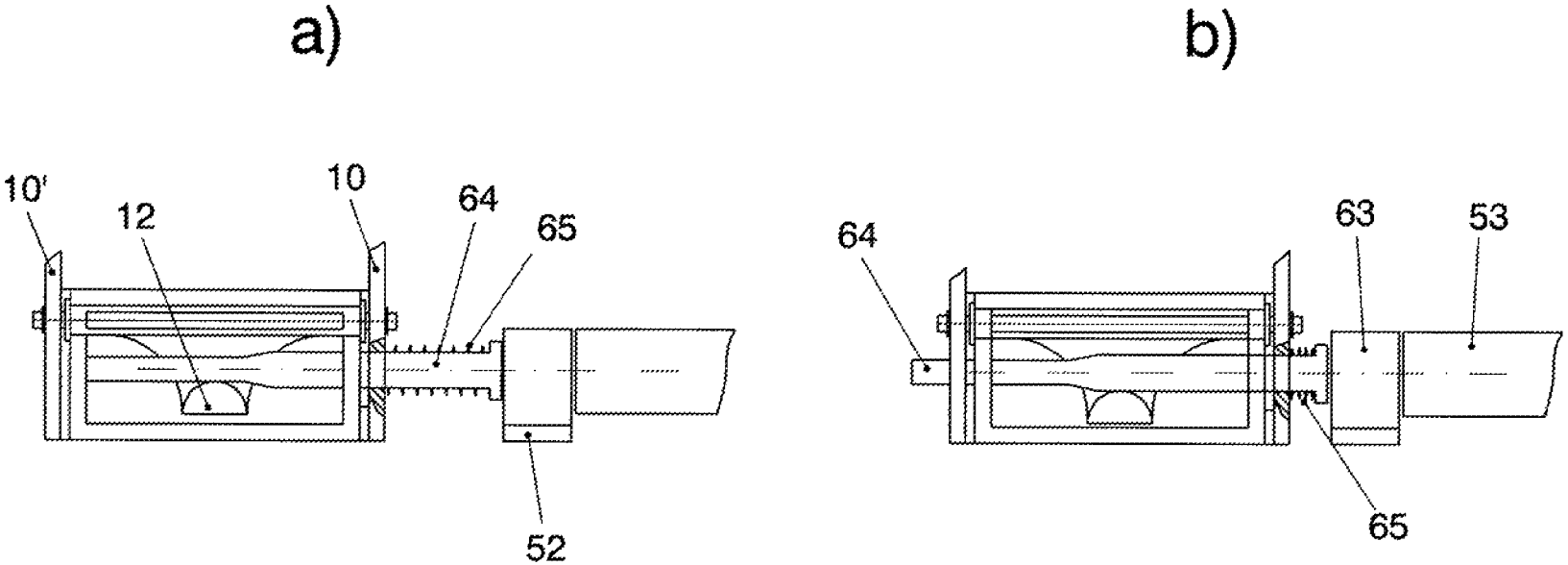
FIG. 20.—It shows in two positions a) and b) the section obtained by a cutting plane through line D in FIG. 19.
Figure 21:
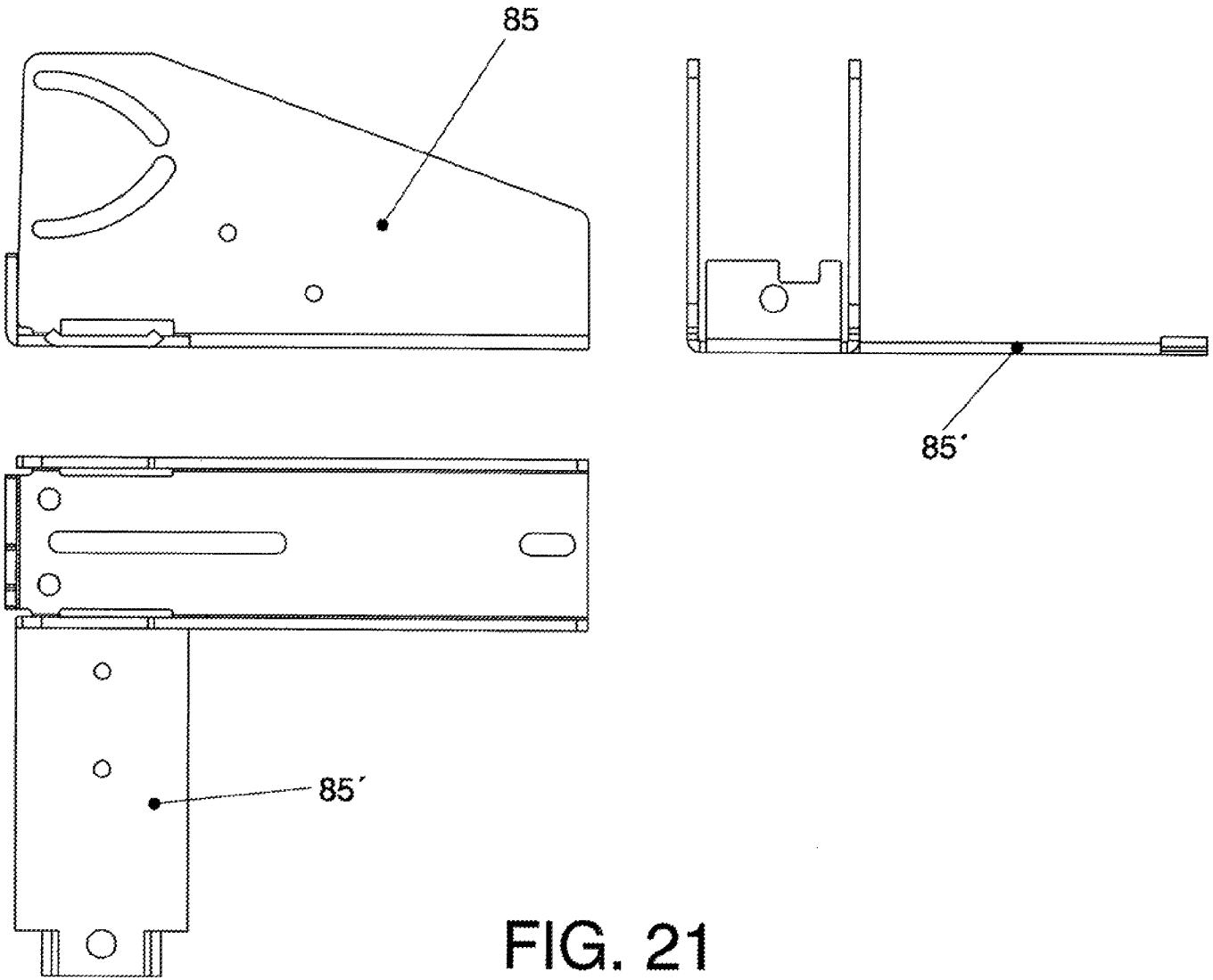
FIG. 21.—It shows the spagnolette frame joined, in one of its symmetric configurations, to the side frame.
Figure 22:
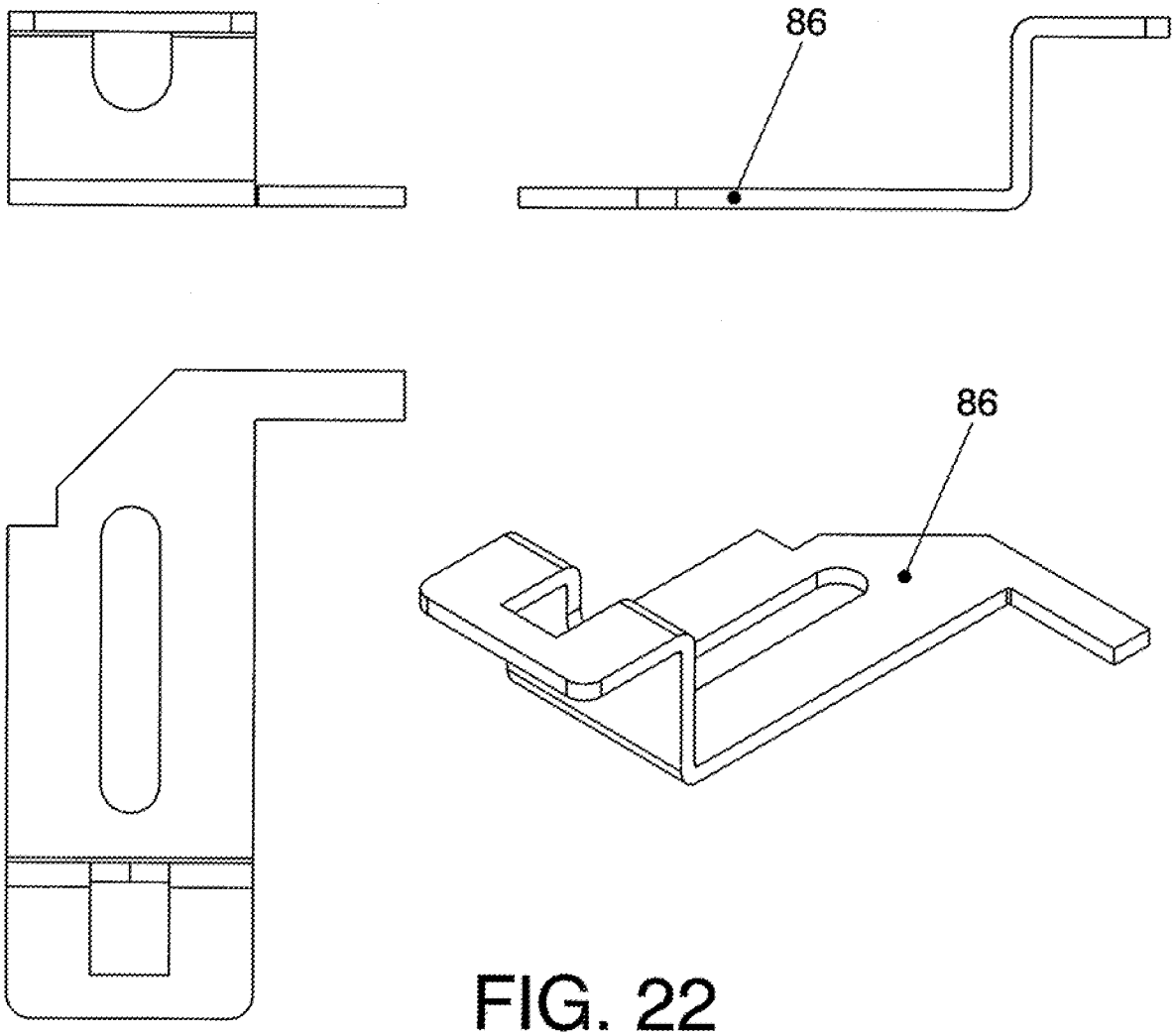
FIG. 22.—It shows the angular retainer corresponding to the configuration generated in the assembly.
Figure 23:
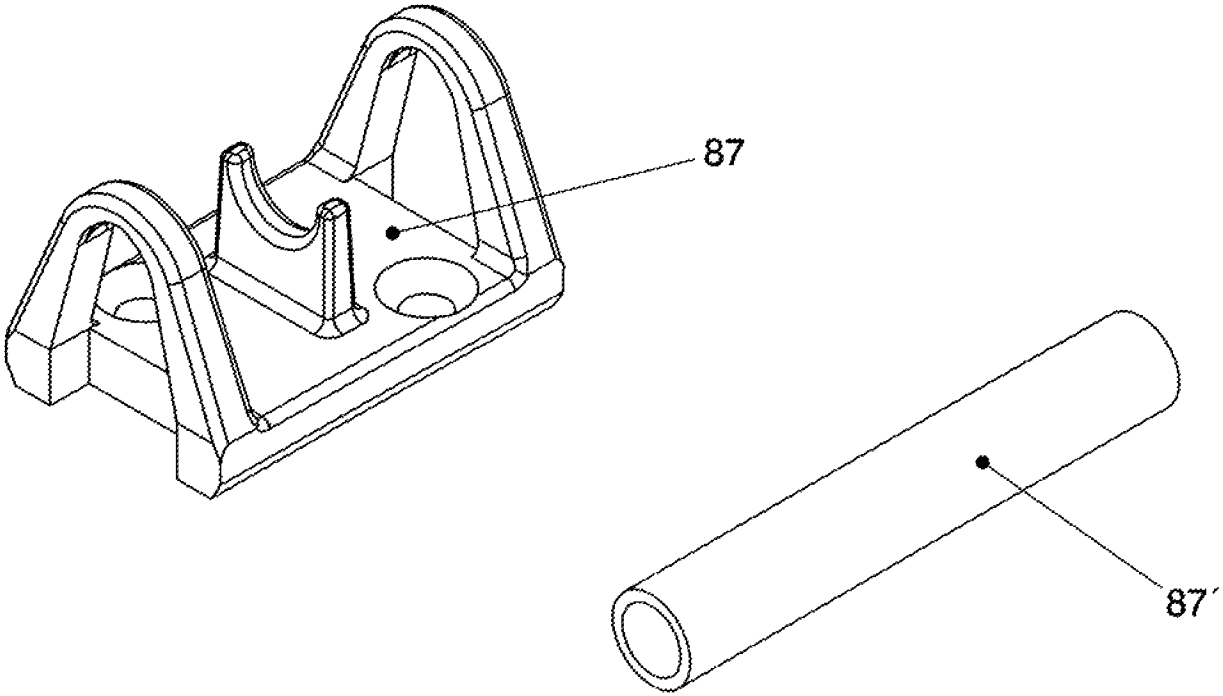
FIG. 23.—Perspective of the guide supporting element for the spagnolette and corresponding bushing for its adjustment.
Figure 24:
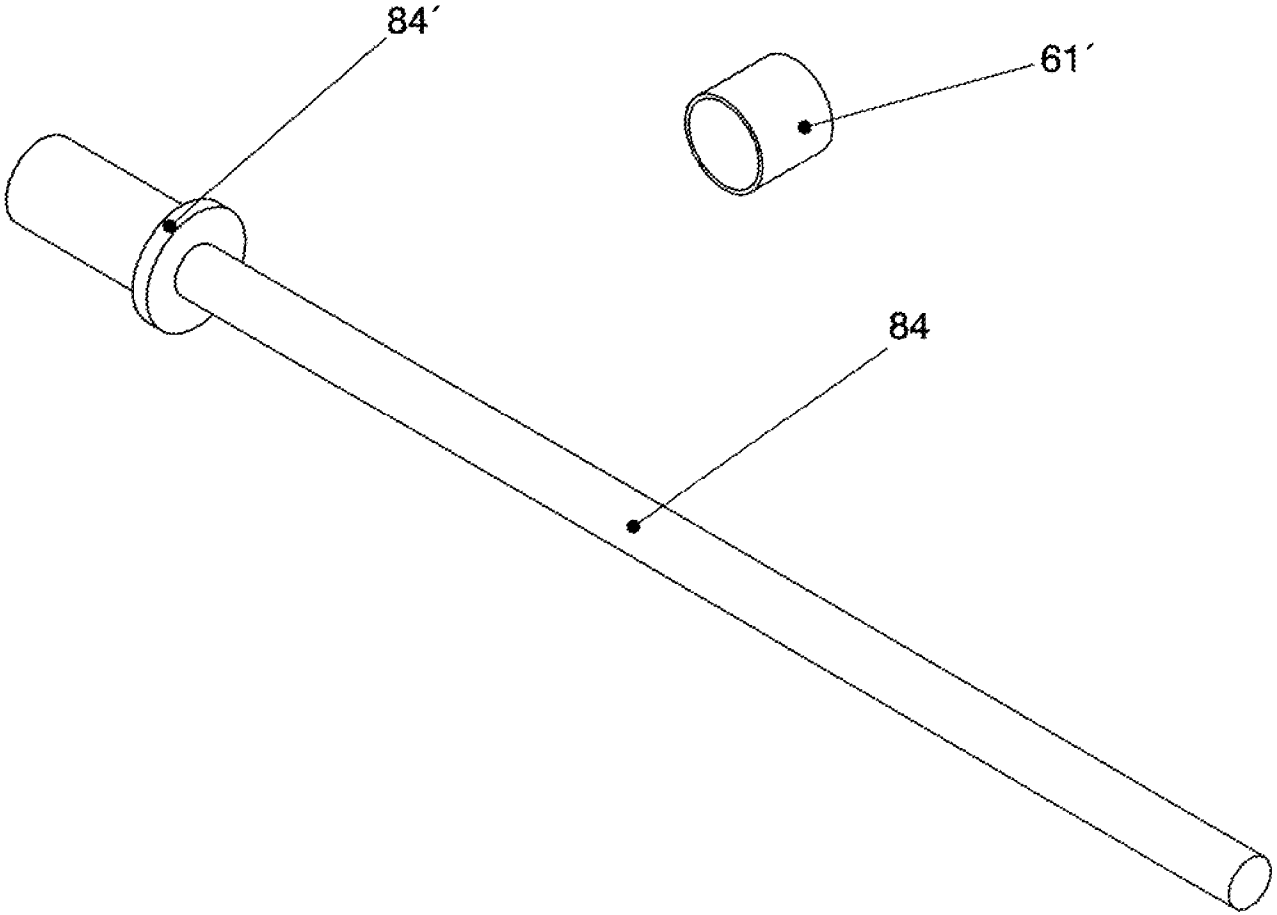
FIG. 24.—It shows another view of the spagnolette, integrating the support of its return spring.
Figure 25:
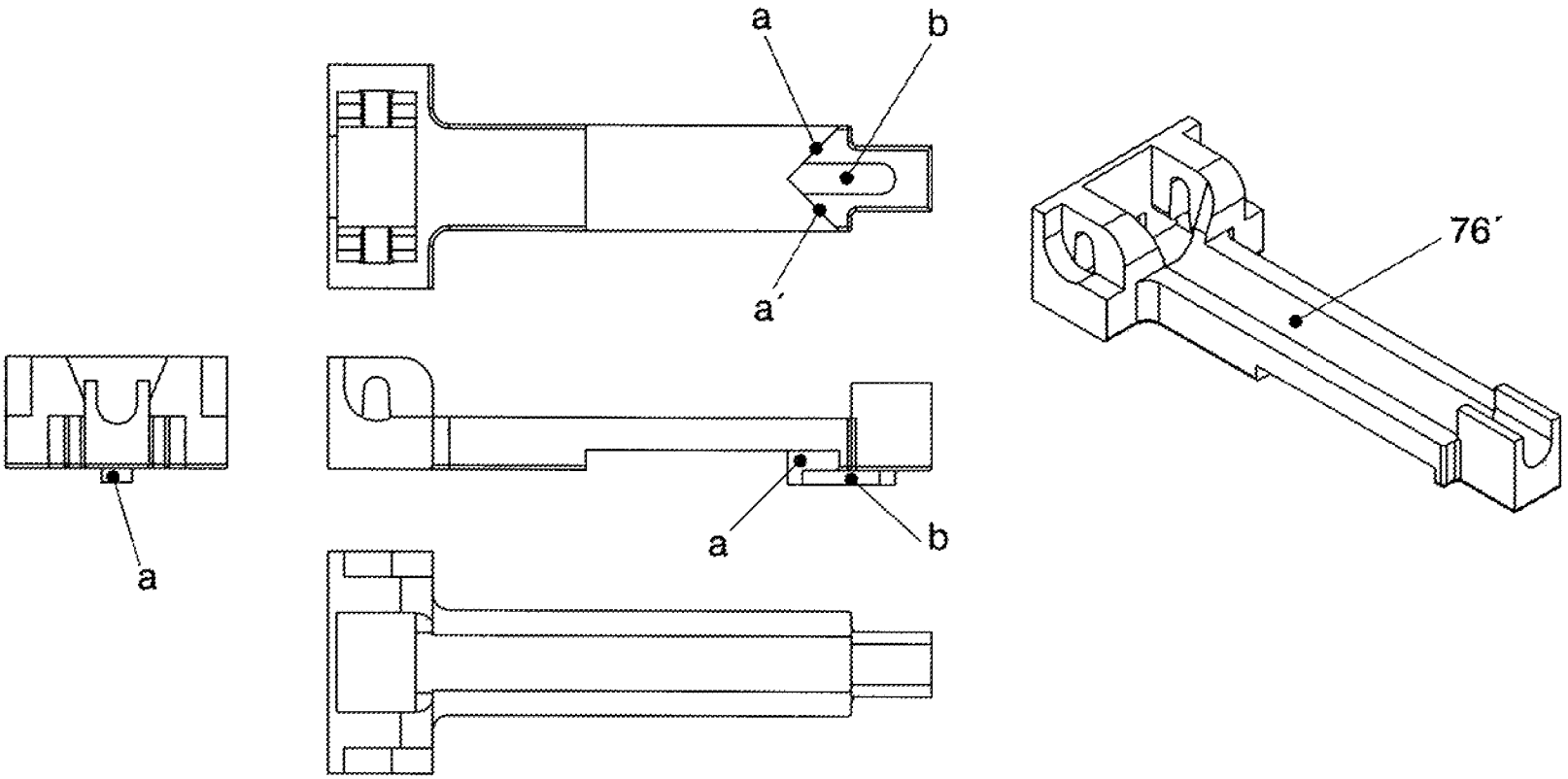
FIG. 25.—It shows different projections of the skid in the horizontal spagnolettes.

In FIG. 20, corresponding to a section along the cutting line D in FIG. 19 is shown in two positions a) and b) the schematic form of this application for physically disabled people. It is a simple combination consisting of a mechanical locking bar, in this case electromechanical, wherein the shaft 64 is housed, revolution cylinder to three diameters, the largest serves for supporting the spring 65, the second diameter serves as guide between the first wall of frame 10 which retains that compression spring 65 already within the frame, and after the cone-shaped machining, its third diameter is perfectly guided in the second wall of frame 10', this mechanism being retained by the positioning of the dowel 63 integral with the rod 52.

The second component of the referred combination is determined by the auxiliary bar for physically disabled people, it is "rigorous" with four operational components: two "inverted" levers joined through the synchronous shaft 37 with respective return springs 49 even more flexible than the configuration of the upper bar, because its function is simply to recovery the weight of its movable half-bar 2.

A single shuttle 43 (right or left) according to the rotation of the door to which it is intended, that at the front incorporates a pusher dowel 44 and rod 51 for shutting of spagnolette 53, practically symmetrical to the rod 52.

The spagnolette 53 which moves between the guides of the supporting elements of both bars performs the connection and the operational function of this application.

In this tandem a main electromechanical bar is applied in order to optimize the exit, since by physically actuating on the bar for physically disabled people, the rod 52 acts on a switch for enabling a timed electric aperture, which function requires no permanent pressure actuation on the movable half-bar 2, just exerting a first impulse.

With that tandem and from the electrical signal described, of the main bar and in a deficiency manner, another signal can be sent for the door motorization and automatic aperture.

In all configurations for physically disabled people, the pressures that have to be exerted are practically only to overcome the hydraulic spring included in the door for positioning thereof.

This family of modular bars with small linear movements and flexible compression springs, commits, by sacrificing the pure competitiveness, to the reliability of its components seeking solutions in alloyed foundries specific for the involved elements with greater responsibility, generating solids of equal resistance.

The cascade tension reduction design, the implementation of the compensating compression spring and advantage levers for being actuated, result in a vector of minimal effort, and consequently in those electrical, in a low-energy consumption. The power supply needed for its control, with inhibition, does not exceed 3.5 W. In the case of power failure "under remote aperture", with or without inhibition, the electrical panic bars instantaneously behave as RF mechanical bars."

All guides of: frames, rocking shafts of the latch, lever stoppers and the movement of the synchronous shaft, are covered with polyamides suitable for collision and dimensional stability. This implementation provides minimum friction coefficients, greater reliability and significantly reduction of the noise pollution.

Figure 26:
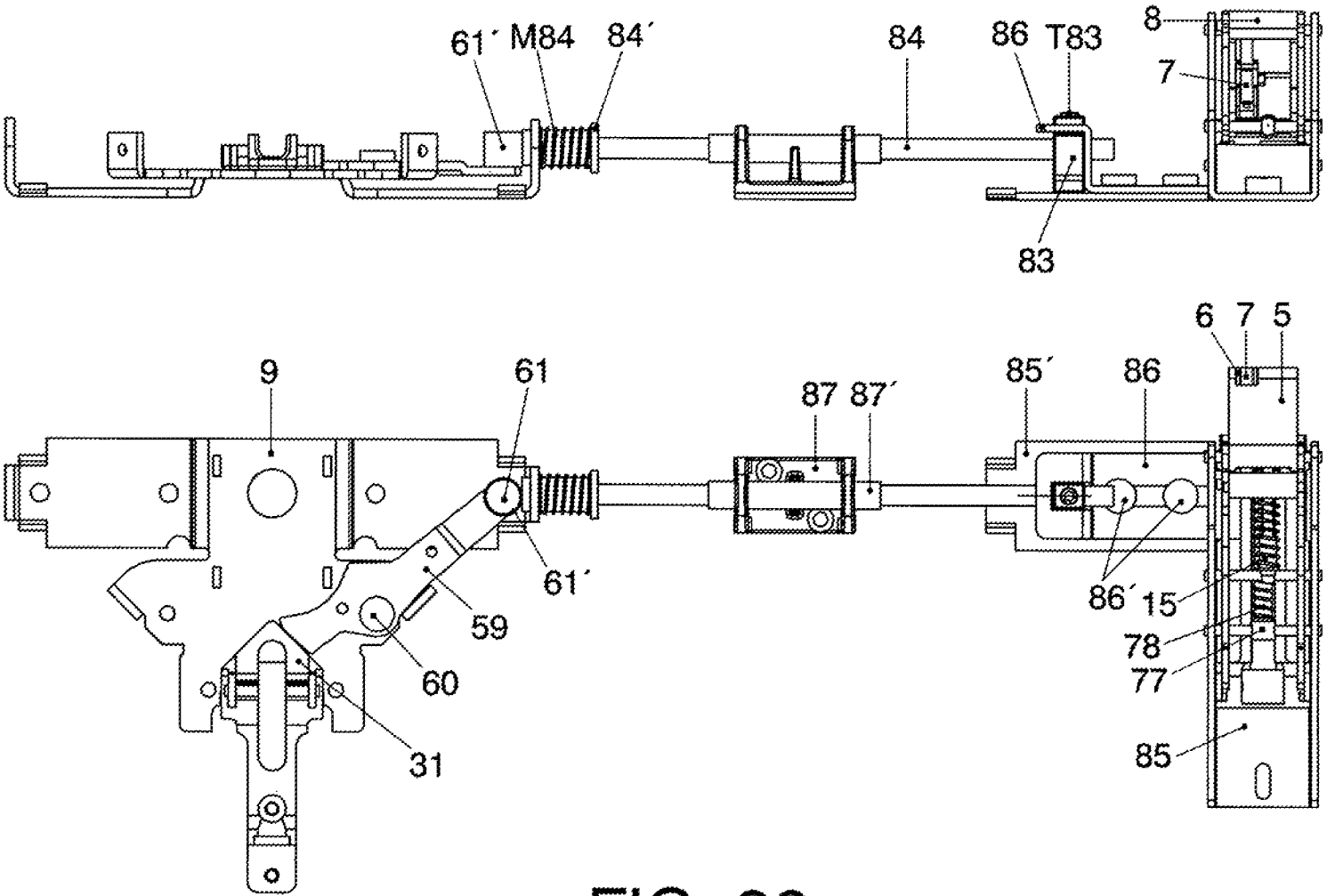
FIG. 26.—It shows the plan and elevational view of the assembly of the vertical spagnolette sub-assembly to the main bar, with the adjustment elements not yet removed.
Figure 26A:
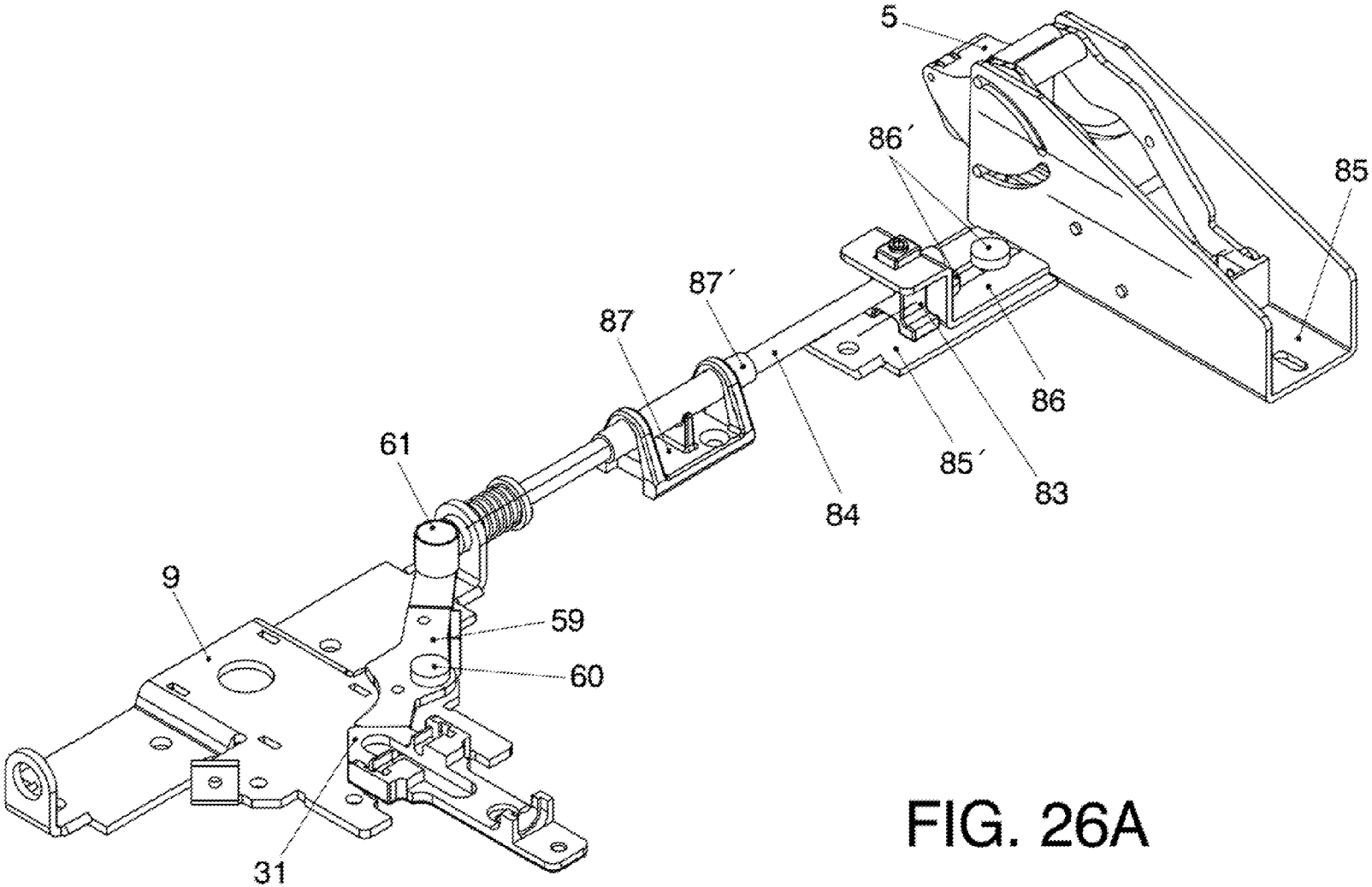
FIG. 26A.—It shows the perspective of the assembly of the vertical spagnolette sub-assembly to the main bar with the adjustment elements not yet removed, of FIG. 26.
Figure 27:
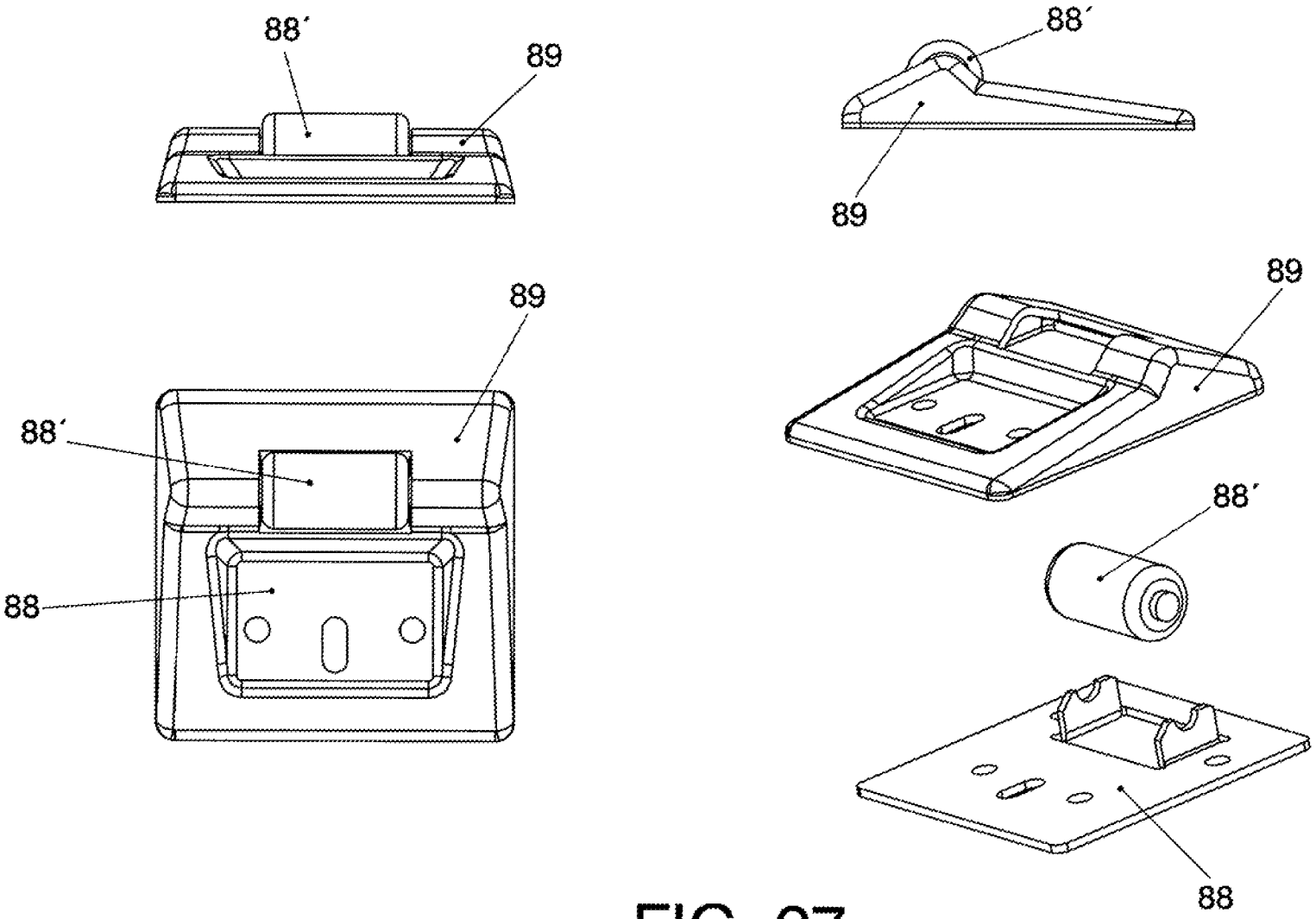
FIG. 27.—Perspective and exploded view of the essential elements making up this ground lock.
Figure 28:
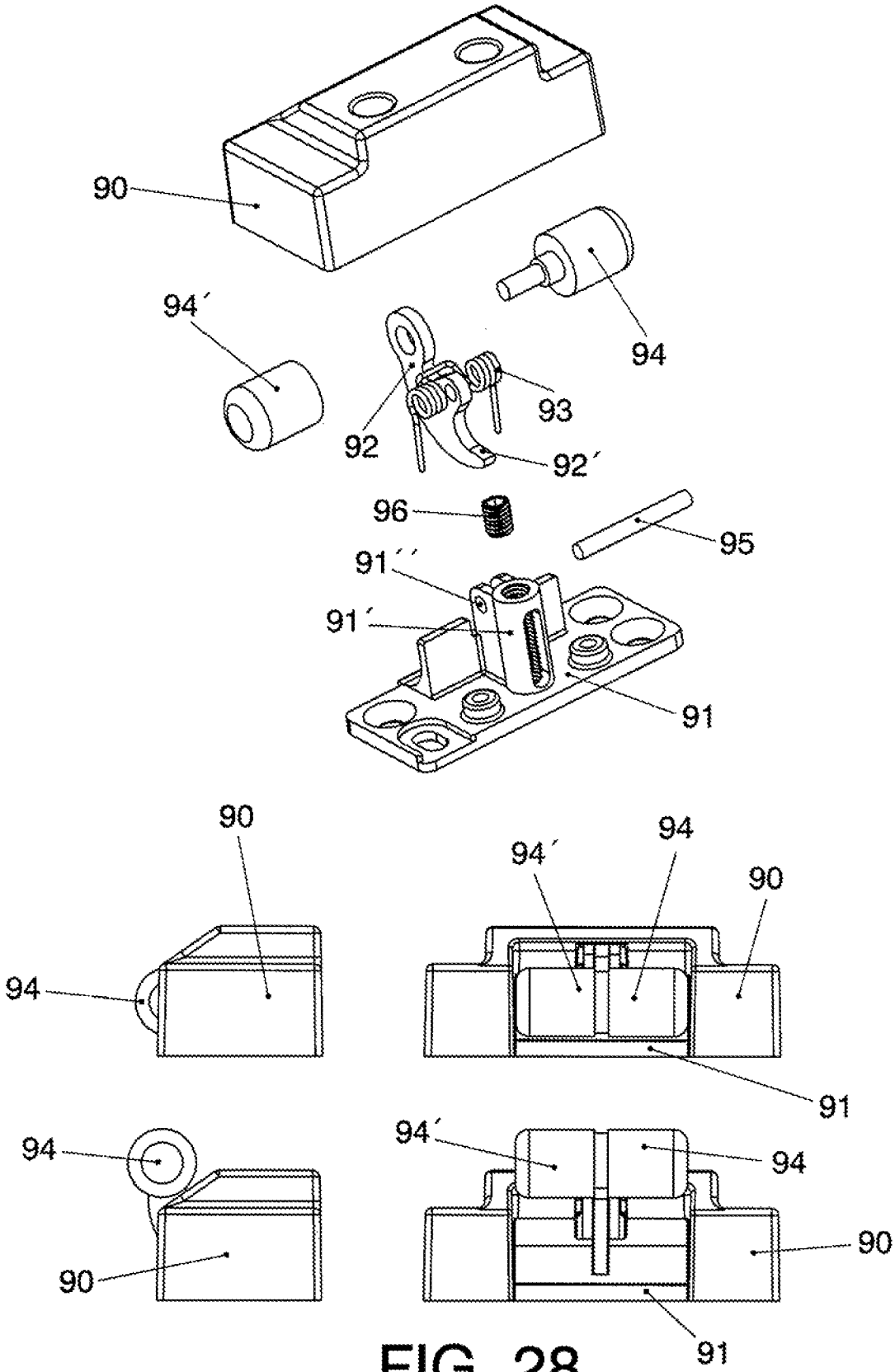
FIG. 28.—Perspective and exploded view of the configuration of the adjustable side lock.

Locking mechanisms in horizontal spagnolettes (FIG. 26) includes, in a modular way, the same elements of the main bar and vertical spagnolettes; the latch 5, the same self-locking system 6, 7 and 8, the same pivoting rod 15, retaining rods 14, the same guide supporting element 83 and the same stem 77 for positioning the skid of spagnolettes. This stem 77 and the rods being articulated on a symmetric skid 76' including an angular prism (a, a') and a guide (b) sliding on a groove that has frame of the mechanism for such purpose, which prevents the axial movement of this skid 76' by being locked by the angular and bent retainer 86, this retainer 86 is moved by the supporting element or transverse frame 85' in a route limited by the pins 86' in the sliding guide existing in the angular retainer 86 and houses, with some looseness, in the angled crenellation the common guide supporting element 83 provided with a screw T83 for the straight movement through the spagnolette 84 with the main bar. Thus the variety of bar articulations is complemented with vertical, horizontal or mixed spagnolettes.

This spagnolette 84 is topped with a cap 84' which aims to adjust the different diameters of the spagnolette shank and guide tabs of the head supporting element, while serving as housing for a compression spring M84 function of which is to recover retainer element 86, after the unlock cycle.

Also, according to the spirit of the title, a guide supporting element 87 is generated, which is common for vertical and horizontal mechanisms, with crenellated design determining a three-point plane for adjusting to the spagnolette 84 with a diameter slightly greater than said shank that enables inserting a bushing 87' for stiffening the guide supporting element 87, allowing no deviation at the time of attaching the supporting element 87 to the frame, then moving this bushing 87' from the crenellations being positioned by gravity without interferences on the lower supporting elements of the spagnolettes. With this simple operation the alignment is established without producing any friction during the normal movement of the spagnolette.

The same philosophy allows a precise adjustment when attaching the spagnolettes 84 in their guide supporting element 83 through the screw, and pressing thereof on the second bushing 61' located on the rod pin retaining the spagnolettes 61, once locked the spagnolette shank 84 this adjustment bushing 61' is removed and discarded, being the combination well regulated.

Finally and in order to optimize the Standard EN1125, object of the present invention, a redesign on conventional locks has been made, including, for minimizing the friction on the latches, rolling planes.

The actuation on the "ground lock" is very graphic. It starts with a supporting element 88 with two crenellated embossments used as a "bed" for a solid impeller 88' and in the enveloping 89 making up the sub-assembly, respecting the angles of incidence contemplated by the standard, a window is opened for the correct assembly of these three elements.

In the side lock, its increased complexity is due to the needed correction having thereof, according to the profiles wherein the different heights showed by the door implementing plans with respect to the frames, are installed.

In this adjustable side lock except for the enveloping adjustable side lock 90 the rest of the elements are made in the Standard EN1125.

It begins from a supporting element 91 jointly connected with a threaded and milling guide bushing 91', this supporting element 91 crenellated in cross-section houses a rocker 92 bearing a double coil spring 93 and inserts into the crenellation of the supporting element 91 and retained by the rocker shaft 95, being attached through drills 91". This rocker 95 joins with sliding adjustment two male-female impellers 94, 94' rigidly assembled. The position of the impellers 94-94' with respect to the plane of incidence of the latch is controlled by a single screw 96 which acts on the radial addendum 92' of the rocker, the pressure generated by the return spring 93 itself being sufficient for stabilizing the attachment of the screw 96 in the desired position. Once installed the frame supporting element 91 in the right place, the enveloping adjustable side lock 90 is attached to supporting element 91. This mechanism allows the adjustment and readjustment, in case of expanding the parameters implanted, without using the classic supplements of conventional locks.

The lower shaft 56 is coupled in its central part to the respective operating lever rocker arm 26, while the ends of such lower shaft 56 are connected with the first shuttle (41) and the second shuttle (42). In the case of the third shuttle (43), to be used by physically disabled people, one single end of the lower shaft 56 is connected to such third shuttle 43. For this, the aforementioned ends of the lower shaft 56 are fitted into transverse grooves 41*b* established in the shuttles (FIG. 6).

The tilt movement of the operating lever rocking arms 26, generated by the front movement of the movable half-bar 2, causes such tilt movement of the operating lever rocking arms 26 the axial displacement of the synchronous modular shaft 37 and the shuttles 41, 43.

Figure 29:
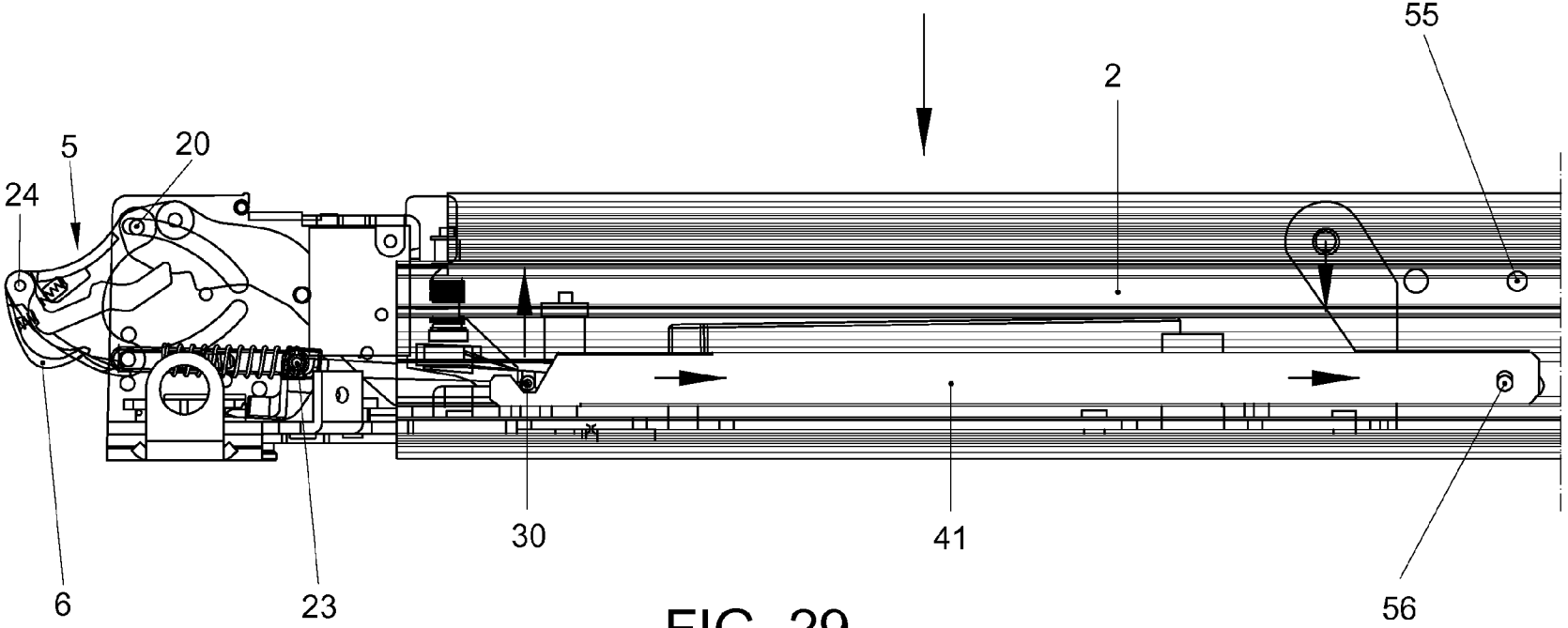
FIG. 29.—It represents an elevational view of the panic bar that includes the improvements of the invention. It essentially shows the release of a modular skid.
Figure 30:
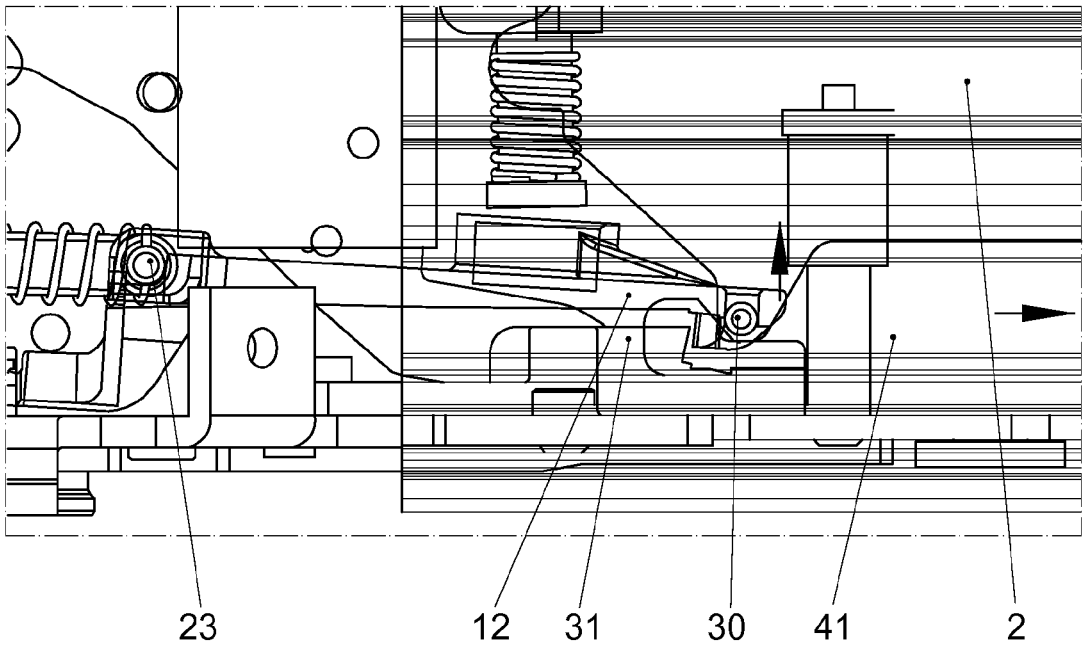
FIG. 30.—It represents a view in detail of what is shown in the previous figure.

FIGS. 29 and 30 show more clearly the release of the modular skid 31. For this, when putting pressure on the movable half-bar 2 the movement is transmitted to the operating lever rocker arms 26 which causes a counter-clockwise concentric rotation around the rotation shaft of the lever 55. This movement causes the lower shaft 56 to move the shuttle 41 to the right in a horizontal direction defined by battlements 1*b* of the stationary half-bar 1 that guide the shuttles 41, such that the movement of the shuttle 41 causes an inclined plane 41*a* of the same to make contact with the main shaft 30 integral with the locking lever 12, thus producing a concentric rotation of said locking lever 12, allowing the release of the modular skid 31.

Figure 31:
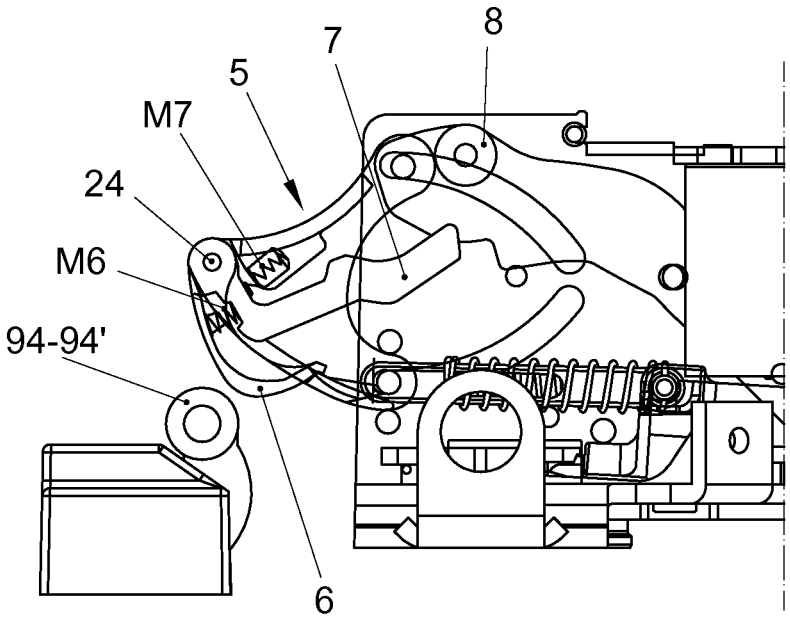
FIGS. 31 and 32.—Represent views that show essentially the positioning of the latch in proximity to the closure of a door and another closed position.
Figure 32:
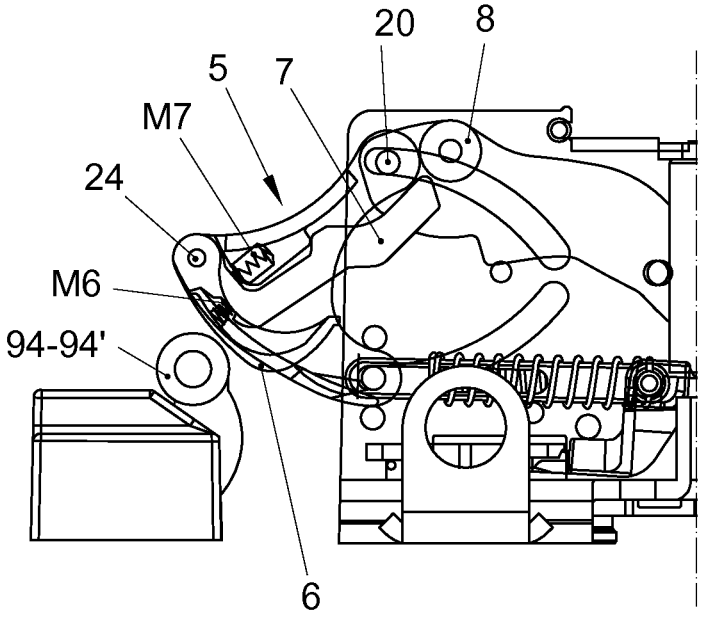

FIG. 31 shows essentially a position near to the "closed door" position and FIG. 32 a "closed door" position.

The operation of the self-locking member is as follows.

When closing the door, the impeller 94-94' collides with the self-locking clutch 6 causing its concentric rotation around the self-locking shaft 24 in counter-clockwise direction to a position defined by the first compensating M6 and second compensating spring M7, that causes that when concentrically rotating the latch 5 around the latch shaft 20 in counter-clockwise direction, a collision between the self-locking lever 7 and retaining stopper 8 occurs, thus reaching the pursued self-locking effect.

Thus, it should be noted that the latch 5 assembly integrates a first cavity which houses the second compensating spring M7 and a second cavity where the self-locking clutch 6 and self-locking lever 7 rotate independently, both elements 6-7 concentrically rotating around the self-locking shaft 24, such elements 6-7 forming along with the retaining stopper 8 of the self-locking lever 7 the elevated self-locking member (6,7,8) assembly, and such retaining stopper is attached in the transmitting rod 14.

The compensating springs (first compensating spring M6, and second compensating sprint M7) push in opposition to the self-locking lever 7 which forms part of the elevated self-locking member (6,7,8).

The invention claimed is:

1. A sliding and modular panic bar with minimum movements, provided with a head case bearing a boss, on which a sliding half-bar slides, through a guide made therein, said bar comprising:

a stationary half-bar including in its extrusion a configuration enabling electrical installation with recesses differentiated of the prewiring and other specific connections, an auxiliary bar operatively connected to the stationary half bar, rails in the stationary half-bar and the auxiliary bar for the modular attachment of supporting elements and frames;

first crenellations in the stationary half-bar for a correct alignment and movement of two first shuttles, second crenellations in the auxiliary bar for a correct alignment and movement of a second shuttle, the half bar comprising a modular synchronous shaft, being rigidly and cadentially attached to operating lever rocker arms through a lower shaft and a non-magnetic rapier, a central part of said lower shaft being coupled to the operating lever rocker arms;

the operating lever rocker arms are hingedly coupled in respective "U"-shaped frames and are hinged at their midpoint in their respective rotation shaft;

each of the first shuttles having one end connected to the lower shaft and an opposed end having inclined planes supporting the ends of a main unlocking shaft embedded in a locking lever, so that when said unlocking shaft is lifted under said inclined planes, a modular sliding skid is released from engagement with the locking lever, said modular sliding skid maintains through a spring bearing the modular synchronous axis, both the positioning of rods retaining vertical spagnolettes and the positioning of a rocking-side hinged latch through its lower and upper positioning shafts thereof by connecting a transmitting rod that couples the rocking-side hinged latch to said modular skid by a crimp shaft and to the latch through one of the positioning shafts thereof;

the rocking-side hinged latch is maintained in emergency position by pressure of a compression spring coaxially arranged in a pivoting and grooved recuperating rod, between the positioning of a lower shaft of the latch and a shaft of the locking lever, the rocking-side hinged latch comprises an elevated self-locking member that includes a self-locking lever, a self-locking clutch, a retaining stopper, a first compensating spring housed by the latch, and a second compensating spring housed on the self locking clutch, said springs push in opposition to the self-locking lever;

the rocking-side hinged latch houses on one side the second compensating spring and on the other side the self-locking clutch and the self-locking lever, the retaining stopper being coupled to the transmitting rod;

the rocking-side hinged latch has a locking mechanism in spagnolettes and is maintained self-locked when positioned on an impeller hooked on a rod-rocker and positioned on its shaft within an adjustable side lock supporting element, and remains inoperative in the remaining rocking-side hinged sequences where the latch is not positioned on the impeller located within the adjustable side lock supporting element.

2. The sliding and modular panic bar with minimum movements, according to claim 1, wherein inside the rails a first supporting element is housed, which joins together head frames having a double arched groove for achieving double depression of the latch in two senses of rotation on the upper and lower positioning shafts, both guided through their ends in the double arched groove;

the elevated self-locking member of the latch being displaced from its geometric center for receiving the recuperating rod which, through a groove therein, moves over one of the lower positioning shaft of the latch together with its compression spring;

the locking lever having a first function of serving as an unlocking element, when a follower is actuated on an external addendum thereof and the follower capable of being actuated on an axial displacement shaft that drives an adjacent addendum of the locking lever;

the locking lever also having a second function as an armor in electrical configurations, for housing its return spring and ensuring in its embossment that in case of fire when a fuse is melted, the locking lever is kept retained by a spring maintaining the locking;

the head frames being assembled, at the top, to a supporting element of a coil making up the head block stiffness.

3. The sliding and modular panic bar with minimum movements, according to claim 2, wherein:

the modular skid is crimped to an electromagnetic armor, the electromagnetic armor comprising a core;

the modular skid being a solid having at its anterior part a triangular-prism configuration, and maintaining in the middle part thereof the parallelism by the situation of its transmitting rod;

the modular skid is guided by a polyamide bushed separator fitted in a groove of the modular skid, the separator limiting the movement of the modular skid and preventing the metal collision of the latch shaft on the frames;

the modular skid having on its back an open crenellation where a polyamide bushing for displacement of the synchronous shaft is housed.

4. The sliding and modular panic bar with minimum movements, according to claim 3, wherein the synchronous shaft is rigidly associated to a first operating lever rocker arms through their lower shafts, and the synchronous shaft is rigidly associated to a second operating lever rocker arm through a rocking guide shaft;

the rocking guide shaft moves independently not associated to the dragging of the synchronous axis between the "U" shaped frames of the levers that support the operating lever rocker arms;

the "U" shaped frames house in their crenellations, closed at the top and open at the bottom, two separate polyamide bushings loosely in a vertical direction for absorbing the pendulum effect created by the operating lever rocker arms articulation, when the movable half-bar acts on an operating shaft with a bearing of the operating lever rocker arms;

the lower shaft is assembled with the shuttles housed in the crenellations existing in the stationary half-bar for such purpose;

the springs included in the synchronous shaft, both for retaining and recuperating the levers, are of compression, springs;

the rapier of the second operating lever rocker arm is non-magnetic, but when a permanent magnet is included its behavior is bi-positional, feature that enables the movement of a frame guided on the synchronous shaft in a very simple manner within the stationary half-bar to the extent desired, for adjusting the standard bar, with the synchronous shaft being grooved at cadence distances from the interlocking housings for allowing the manual rupture of the extra part thereof.

5. The sliding and modular panic bar with minimum movements, according to claim 1, wherein the locking mechanisms in spagnolette modularly include the latch of the main bar, the self-locking system, the pivoting rod and identical transmitting rods, these transmitting rods are articulated in a skid having a longitudinal grooved base where a boss is housed for delimiting and guiding the skid movement;

the boss is fixed to a frame and it is covered with a polyamide guide bushing;

at its front, the skid retains a return spring of a stem attached to the frame by a shaft, this stem being guided in its end by the crenellation included at the frame;

the skid is housing a guide support element, which retains a spagnolette by attaching a screw.

6. The sliding and modular panic bar with minimum movements, according to claim 2, wherein, a bar tandem is joined, and the sliding panic bar further comprises a shaft which, with a minimum movement and extensive post-race, enables the unlocking by acting on the complementary bar, such complimentary bar comprising "inverted operating lever rockers" which are attached to the "U" shaped frames;

the operating lever rockers move and push the third shuttle and because of the nexus of a spagnolette to the rod tandem, they also move with minimum effort the shaft from the resting position, a spring coupled with the shaft is the only element to restore the operating cycle of the rod or shaft.

7. The sliding and modular panic bar with minimum movements, according to claim 5, wherein locking mechanisms in horizontal spagnolettes modularly includes the elements of the main bar and vertical spagnolettes, the latch, the self-locking system, the pivoting rod, the transmitting rods, the guide supporting element and the stem for positioning the skid of spagnolettes; this stem and the transmitting rods are articulated on a symmetric skid including an angular prism and a guide sliding over a groove existing in the frame of the spagnolettes mechanism for such purpose, which prevents the axial movement of this skid by being locked by the angular and retainer;

this retainer is moved by a transverse frame in a route limited by pins fitted in the sliding guide existing in the angular retainer;

the angular retainer having an angled crenellation that loosely houses in the angled crenellation the common guide supporting element provided with the screw for the straight movement through the spagnolette with the main bar, all of this with the purpose of complementing the variety of bar joints is complemented with vertical, horizontal or mixed spagnolettes; and the spagnolette is topped with a cap which is intended to adjust the different diameters of the spagnolette shank and guide tabs of the head supporting element, while serving as housing for a compression spring the function of which is to recover the angular retainer, after the unlock cycle.

8. The sliding and modular panic bar with minimum movements according to claim 5, further comprising a guide supporting element, which is common for vertical and horizontal mechanisms, with a crenellated structure determining a three-point plane for adjusting to the spagnolette, with a diameter slightly greater than said spagnolette that enables inserting a bushing for stiffening the guide supporting element, allowing no deviation at the time of attaching the supporting element to the frame;

the bushing being positioned by gravity without interferences on the lower supporting elements of the spagnolettes, such that the alignment is established without producing any friction during the normal movement of the spagnolette;

a precise adjustment is achieved when attaching the spagnolettes in their guide supporting element through its screw, and pressing the spagnolette through its axis on a second disposable bushing located on the rod pin retaining the spagnolettes;

and once the spagnolette shank is locked, this adjustment bushing is removed and discarded.

9. The sliding and modular panic bar with minimum movements, according to claim 1, further comprising a supporting element having two crenellated embossments serving as“ ” bed for a solid impeller and also having an envelope making up the supporting element-impeller sub-assembly, and a window is also opened for the correct assembly of these three elements, all these features in order to minimize the friction on the latches and rolling planes, in such a way that in a side lock envelope, the rest of the elements are made of steel, except the envelope itself;

a supporting element which is integral with a threaded and milling guide, this supporting element having a crenellated cross-section and housing a rocker bearing a double coil spring and inserted into the crenellation of the supporting element and being retained by a rocker shaft, being attached through drills”;

this rocker shaft joins with sliding adjustment two male-female impellers rigidly assembled between them;

the position of the impellers with respect to the plane of incidence of the latch is controlled by a single screw which acts on the radial addendum of the rocker, the pressure generated by the return spring itself being sufficient for stabilizing the attachment of the screw in the desired position;

once the frame supporting element is installed in the right place, only the envelope remains to be attached to the supporting element; this resulting configuration allows the adjustment and readjustment, in case of expanding the parameters wherein it is implanted, without using the classic supplements of conventional locks.

* * * * *